US007032943B1

(12) United States Patent
Marler

(10) Patent No.: US 7,032,943 B1
(45) Date of Patent: Apr. 25, 2006

(54) APPARATUS WITH A LOCKING MECHANISM FOR THE LATCHING AND UNLATCHING OF A LOAD

(76) Inventor: Joseph E. Marler, 29736 W. Highland, Livingston, LA (US) 70754

( * ) Notice: Subject to any disclaimer, the term of this patent is extended or adjusted under 35 U.S.C. 154(b) by 0 days.

(21) Appl. No.: 10/906,129

(22) Filed: Feb. 3, 2005

(51) Int. Cl.
*B66C 1/34* (2006.01)

(52) U.S. Cl. ..... 294/82.31; 294/82.34

(58) Field of Classification Search ..... 294/82.31, 294/82.33, 82.2
See application file for complete search history.

(56) References Cited

U.S. PATENT DOCUMENTS 1,202,029 A * 10/1916 Chambers et al. ..... 294/82.33
2,864,644 A * 12/1958 Marryatt ..... 294/81.51
2,998,277 A * 8/1961 Himel, Jr. ..... 294/75
3,895,836 A * 7/1975 Barnes ..... 294/82.35
4,077,661 A * 3/1978 Inahashi ..... 294/82.3
4,103,856 A * 8/1978 Riblet ..... 248/246
5,100,192 A * 3/1992 McMillan ..... 294/82.31
5,152,567 A * 10/1992 Raber ..... 294/82.35
5,522,631 A * 6/1996 Halonen ..... 294/66.1
5,762,389 A 6/1998 Marler
5,791,710 A 8/1998 Marler
6,024,394 A * 2/2000 Marler ..... 294/75
6,089,634 A * 7/2000 Verhey ..... 294/82.35

* cited by examiner

*Primary Examiner*—Eileen D. Lillis
*Assistant Examiner*—Esther Onyinyechi Okezie
(74) *Attorney, Agent, or Firm*—Roy, Kiesel, Keegan and DeNicola

(57) ABSTRACT

An apparatus for the loading and unloading of material is disclosed. The apparatus comprises a latching and unlatching mechanism that safely and efficiently releases an attached load from a sling after the load has been transported to the desired location. The apparatus further comprises a load-activated locking mechanism that prevents inadvertent release of the attached load, yet is adjustable to the weight of the lifting slings and hardware so as to prevent a premature locking.

29 Claims, 22 Drawing Sheets

APPARATUS WITH A LOCKING MECHANISM FOR THE LATCHING AND UNLATCHING OF A LOAD

BACKGROUND OF THE INVENTION

1. Field of the Invention

This invention relates to apparatuses utilized for loading and unloading materials in general and to an apparatus with a locking mechanism for the latching and unlatching of materials suspended from a lifting line in particular.

2. Prior Art

Devices used to load and unload materials for construction and maintenance purposes at residential, commercial, and industrial facilities are well known in the prior art, however, there remains a need for their improvement. For example, in many cases, after a load has been transported and properly positioned in preparation for its release, many prior art loading devices are constructed so that personnel are required to travel to the top of the lifted load in order to detach it from the loading device. Besides involving the risk of fall hazards, this procedure is also time consuming and costly, as it requires ground crew and machinery to slow their operations or come to a stand-still while the task is completed. In addition, many prior art loading devices are neither safe nor reliable as they tend to inadvertently and/or prematurely release the attached load and therefore do not provide for a secure load coupling. Furthermore, many prior art loading devices do not provide for a load-activated locking mechanism that adjusts to the weight of the sling and hardware utilized to attach the load to the device, thereby resulting in a premature locking.

For these reasons, a loading device meeting the following objectives would be highly desirable in the construction industry.

OBJECTS OF THE INVENTION

It is an object of the invention to provide an improved apparatus with a latching and unlatching mechanism for the safe and efficient release of attached loads, so as to reduce operating time, as well as safety and cost concerns associated with lift load operations.

It is another object of the invention to provide an improved apparatus for the loading and unloading of material, that includes an effective load-activated locking mechanism to prevent inadvertent release of attached loads, so as to provide optimal safety for personnel and equipment during lift load operations.

It is another object of the invention to provide an improved apparatus for the loading and unloading of material, that includes an effective load-activated locking mechanism that is adjustable to the weight of the lifting sling and hardware, so as to prevent a premature locking.

These and other objects and advantages of the invention shall become apparent from the ensuing figures and descriptions of the invention.

SUMMARY OF THE INVENTION

An improved apparatus for the loading and unloading of materials is described. The apparatus comprises both a locking mechanism and an unlatching/release mechanism, as is disclosed.

Generally, the apparatus comprises a housing configured to operatively engage a lift line from a crane or similar lifting device, the housing further comprising: a load-engaging member configured to move between a loaded position and a released position, the load-engaging member preferably comprising a standard hook conventional in the industry; a cable having a load end affixed to the load-engaging member and a control end to move the load-engaging member from the loaded position to the released position to detach the load affixed to the load-engaging member; and a load-activated lock configured to secure the cable, when a load is suspended from the load-engaging member, so that if the control end of the cable is inadvertently pulled, the load-engaging member is not accidentally moved to the released position, this feature thereby preventing premature/inadvertent release of the attached load. In addition, the load-activated lock is further configured to adjust to the weight of the slings and hardware utilized to attach the load to the apparatus, this feature thereby preventing a premature locking. The load-activated lock is further configured to release the cable when a load is not suspended from the load-engaging member. At this point, the control end of the cable may then be pulled to move the load-engaging member to the released position, to thereby safely and efficiently release the attached load.

In a preferred embodiment, the apparatus comprises a second load-engaging member, also preferably a conventional hook. The two-hook system of the invention affords various advantages, including an increased capacity on the part of the apparatus to lift greater weight, and a safer and easier mechanism to release and retrieve the load slings and hardware.

DETAILED DESCRIPTION OF THE PREFERRED EMBODIMENTS OF THE INVENTION

Figure 1:
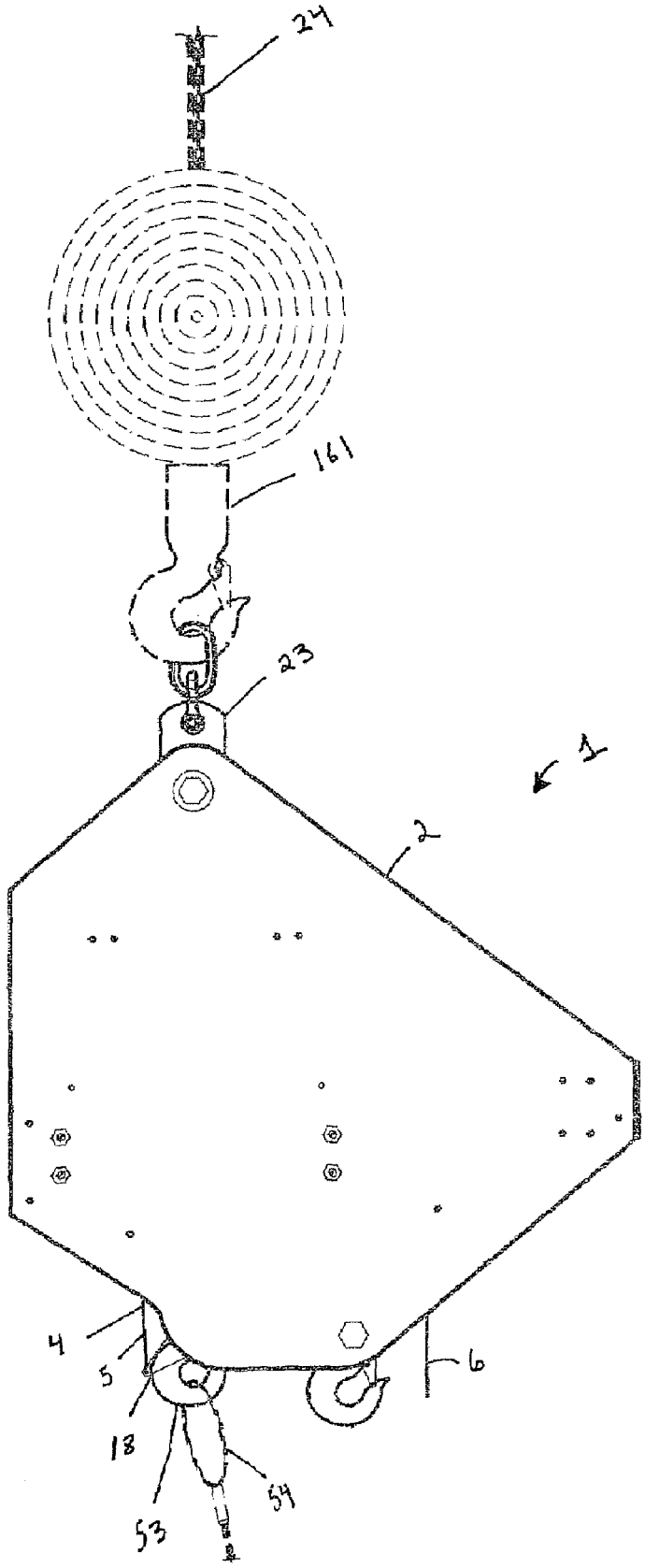
FIG. 1 is a side view of a preferred embodiment of the invention.

The invention provides an improved apparatus, having both a locking mechanism, and a release mechanism, for the loading and unloading of materials.

A preferred latching and unlatching apparatus 1 of this invention includes a housing 2; a load-engaging member 3; a cable 4 having a load end 5 operatively attached to load-engaging member 3 and a control end 6 for unlatching a load 7 attached to load-engaging member 3; a load-activated lock 8 to secure cable 4 when load 7 is suspended from load-engaging member 3, load-activated lock 8 having a lower box 10 fixed to housing 2, a line transfer bar member 11 positioned above lower box 10 and affixed to cable 4 between load end 5 and control end 6, line transfer bar member 11 further having a locking cavity 12, and an upper floating anchor box 13 positioned above line transfer bar member 11 and having locking plates 14; a leveler/spring assembly 15 affixed to housing 2 to bias upper floating anchor box 13; a line transfer compression spring assembly 16 affixed to line transfer bar member 11 to bias cable 4; a hook plate assembly 17 positioned beneath line transfer bar member 11 and attached to load-engaging member 3; a bracket assembly 18 attached to load end 5 of cable 4 and ultimately affixed to load engaging member 3 for attaching load 7 that is to be maneuvered.

Figure 2:
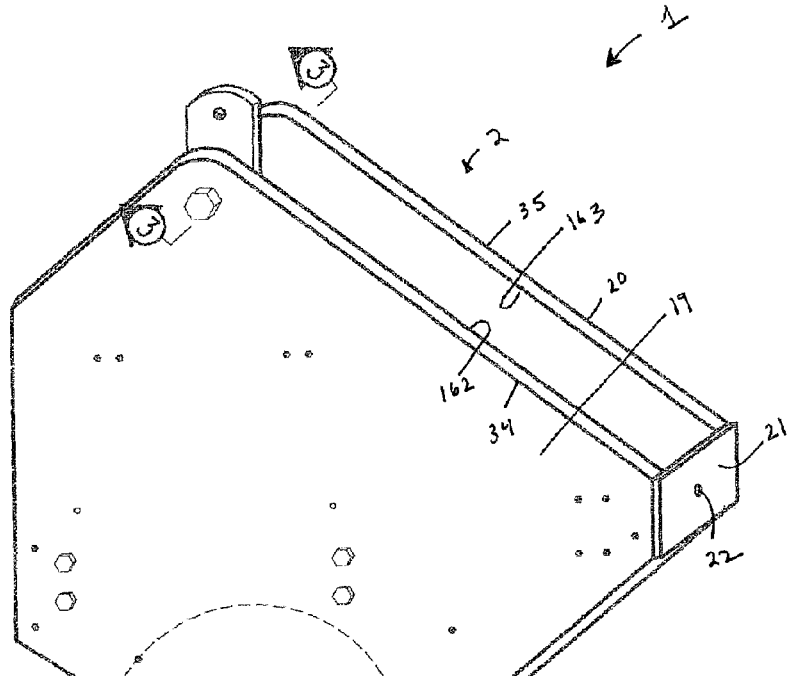
FIG. 2 is a three-quarter perspective embodiment of the invention, depicting the front and back plates of the housing.
Figure 3:
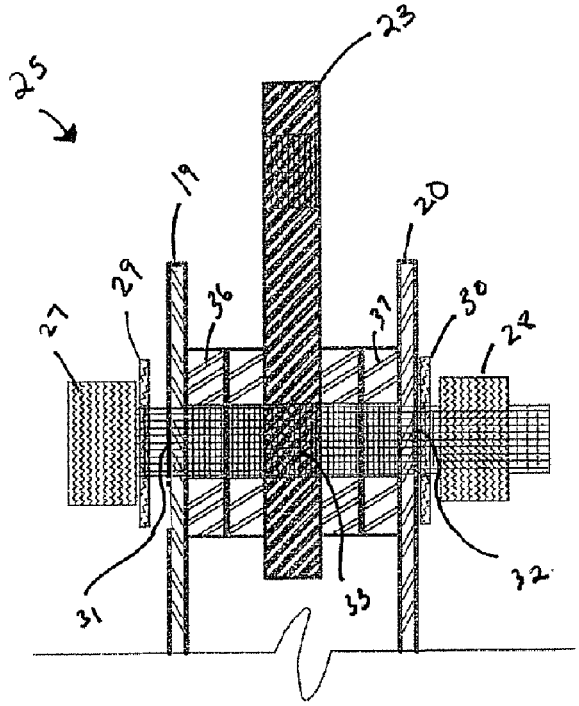
FIG. 3 is a cross sectional view taken along section lines 3—3 of FIG. 2, depicting how the housing plates are operatively joined at this point.
Figure 4:
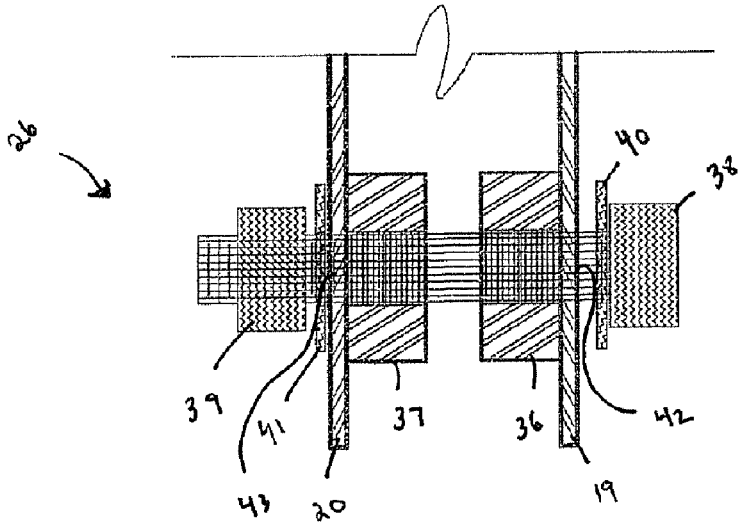
FIG. 4 is a cross sectional view taken along section lines 4—4 of FIG. 2, depicting how the housing plates are operatively joined at this point.
Figure 5:
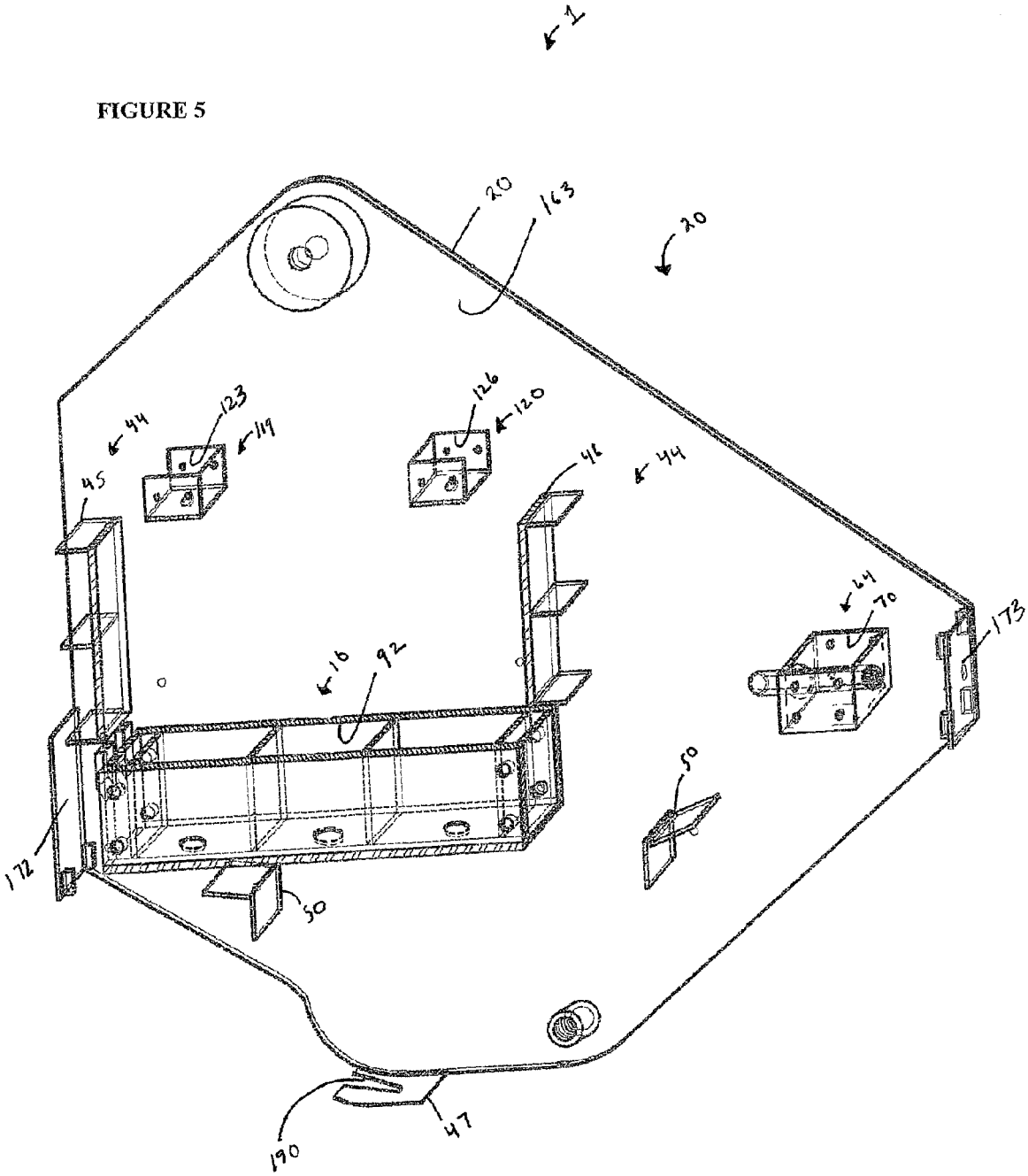
FIG. 5 is a three-quarter perspective view of a preferred embodiment of the invention depicting various components of the invention affixed to the back plate of the housing to provide points of attachment for the front plate and other components when invention is assembled.

As illustrated in FIGS. 1 and 2, housing 2 comprises a parallel front plate 19, a parallel back plate 20 and a horizontal end plate 21. In a preferred embodiment horizontal end plate 21 is provided with a slotted opening 22 to permit cable 4 to be pulled in a horizontal fashion to release attached load 7, as further described below. A hoist crane hook attachment device 23, to operatively engage housing 2 to a crane lift line 24, is positioned between plates 19 and 20. Front plate 19 and back plate 20 are operatively joined to each other at various points in such a manner so as to preserve their parallel integrity. These attachment points are further discussed below. As illustrated in FIGS. 3 and 4, at two points, plates 19 and 20 are fixed in position by upper bolt assembly 25, and lower bolt assembly 26. Upper bolt assembly 25 comprises bolt 27, lock nut 28, and locking washers 29 and 30. Bolt 27 has sufficient length to extend through aligned upper openings 31 and 32 in plates 19 and 20, respectively, as well as through opening 33 provided to hoist crane hook attachment device 23. It is preferred that locking washers 29 and 30 are positioned on bolt 27 to contact plate exterior surfaces 34 and 35 when lock nut 28 is screwed onto bolt 27 and tightened. In a preferred embodiment, interior surface 162 of front plate 19 and interior surface 163 of back plate 20 have thickened shoulders 36 and 37, respectively, to distribute the weight of lifted load 7 so as to preserve the integrity of bolt 27. Lower bolt assembly 26 comprises bolt 38, locking washers 40 and 41, and lock nut 39. Bolt 38 has a diameter and length to permit it to extend through aligned lower openings 42 and 43 of plates 19 and 20 respectively, and is secured via lock nut 39. It is preferred that locking washers 40 and 41 are positioned on bolt 38 to contact plate exterior surfaces 34 and 35 when nut 39 is screwed onto bolt 38 and tightened. Turning now to FIG. 5, housing 2 further includes the following components. In a preferred embodiment, housing 2 further includes a pair of brackets, 171 and 172, welded to each end of back plate 20. Brackets 172 and 173 extend outwardly from interior surface 163 of back plate 20 and are configured to engage front plate 19 of housing 2, so as to provide another point of parallel attachment for front plate 19 and back plate 20 of housing 2. Housing 2 further includes a guide assembly 44 comprising a pair of 'E' shaped vertical brackets 45 and 46 welded to interior surface 163 of back plate 20. Brackets 45 and 46 are positioned adjacent to upper floating anchor box 13, yet are situated at enough distance from upper floating anchor box 13 so as to provide clearance. Brackets 45 and 46, like brackets 172 and 173, are also configured to engage front plate 19 of housing 2, so as to provide another point of parallel attachment for plates 19 and 20. Housing 2 is further provided with a guard latch plate 47, welded to interior surface 163 of back plate 20. Guard latch plate 47 comprises has a slotted opening 190 designed to engage tip end 48 of load-engaging member 3, as further described below. Housing 2 is also provided with one or more rotatable pulleys 49 to allow cable 4 to be directed and redirected as desired, and to provide mechanical advantage to the operator. Finally, housing 2 further comprises stop plates 50 welded to interior surface 163 of back plate 20 in appropriate positions to prevent cable 4 from jumping off pulleys 49.

Figure 2A:
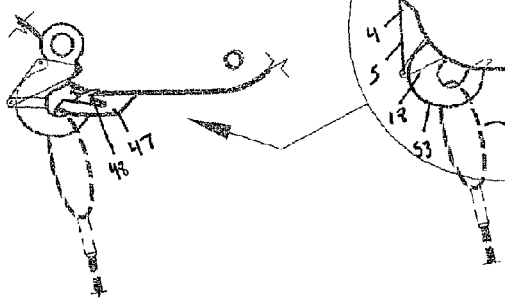
FIG. 2A is an enlarged view of the circled area of FIG. 1, depicting the hook engaged to the guard latch.
Figure 6:
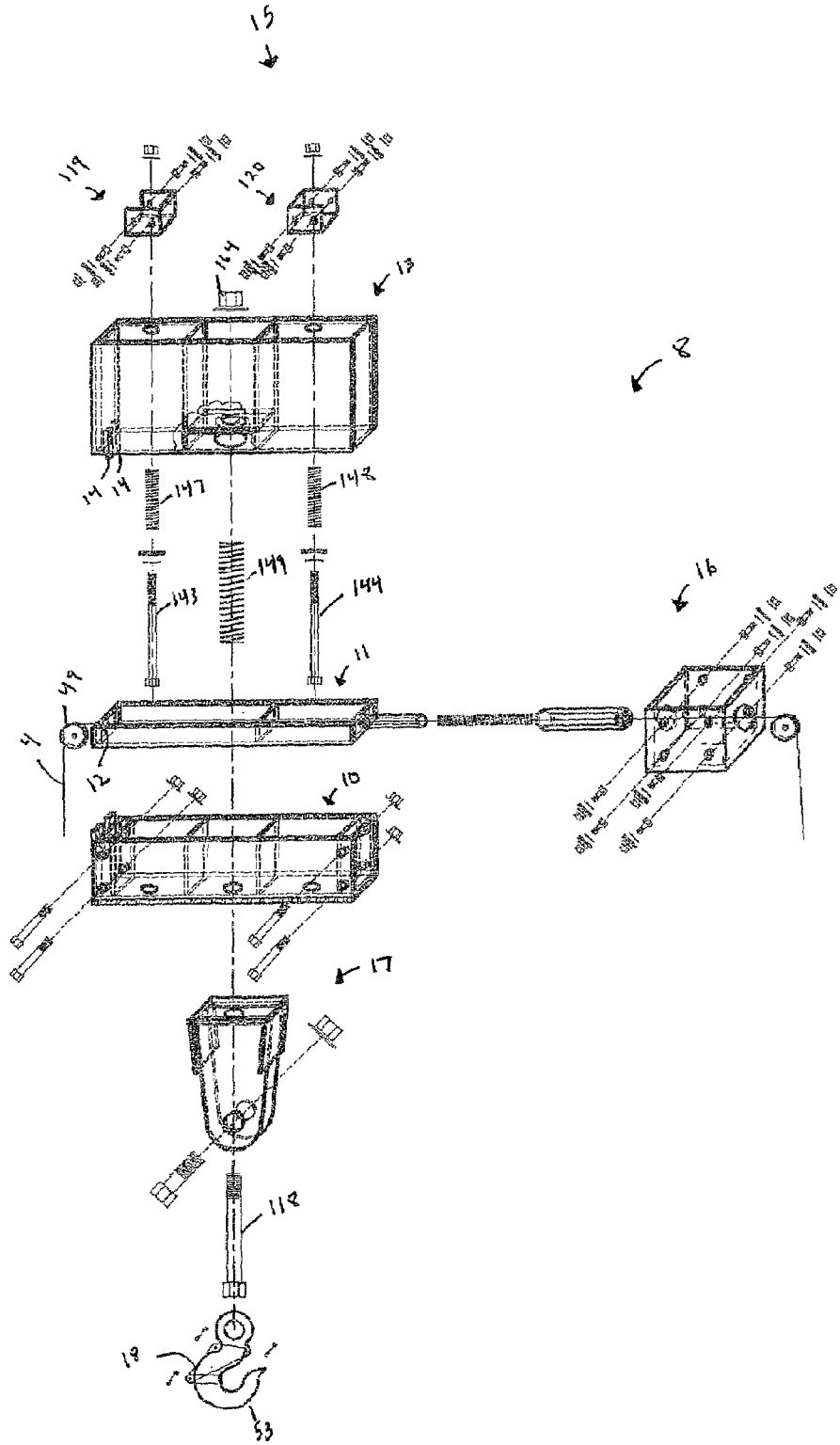
FIG. 6 is an exploded view of a preferred embodiment of the leveler assembly, the load-activated lock, the line transfer compression spring assembly, the hook plate assembly, the bracket assembly, and the load-engaging member.
Figure 13:
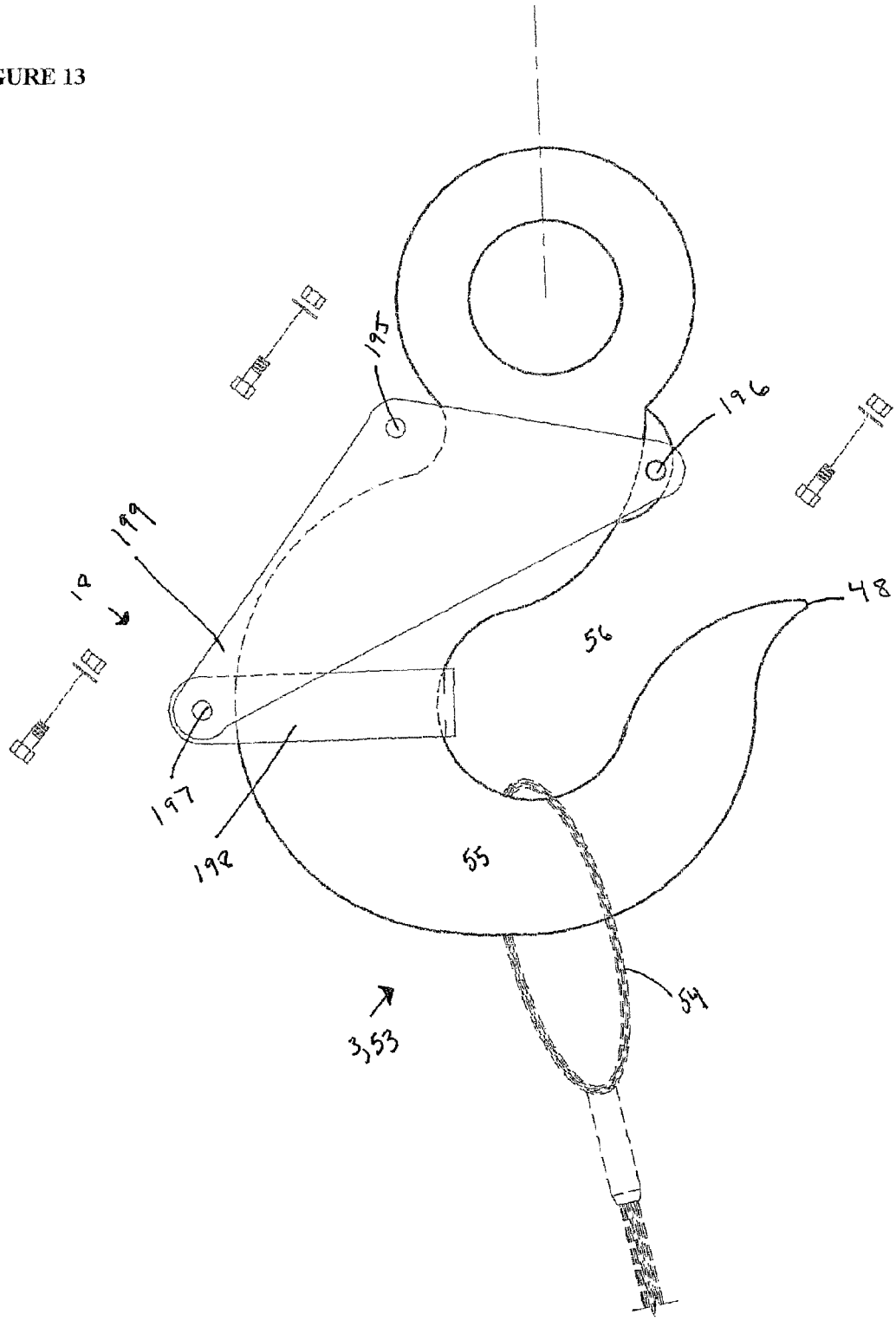
FIG. 13 is a view of the preferred embodiment of the bracket assembly and the hook.
Figure 14:
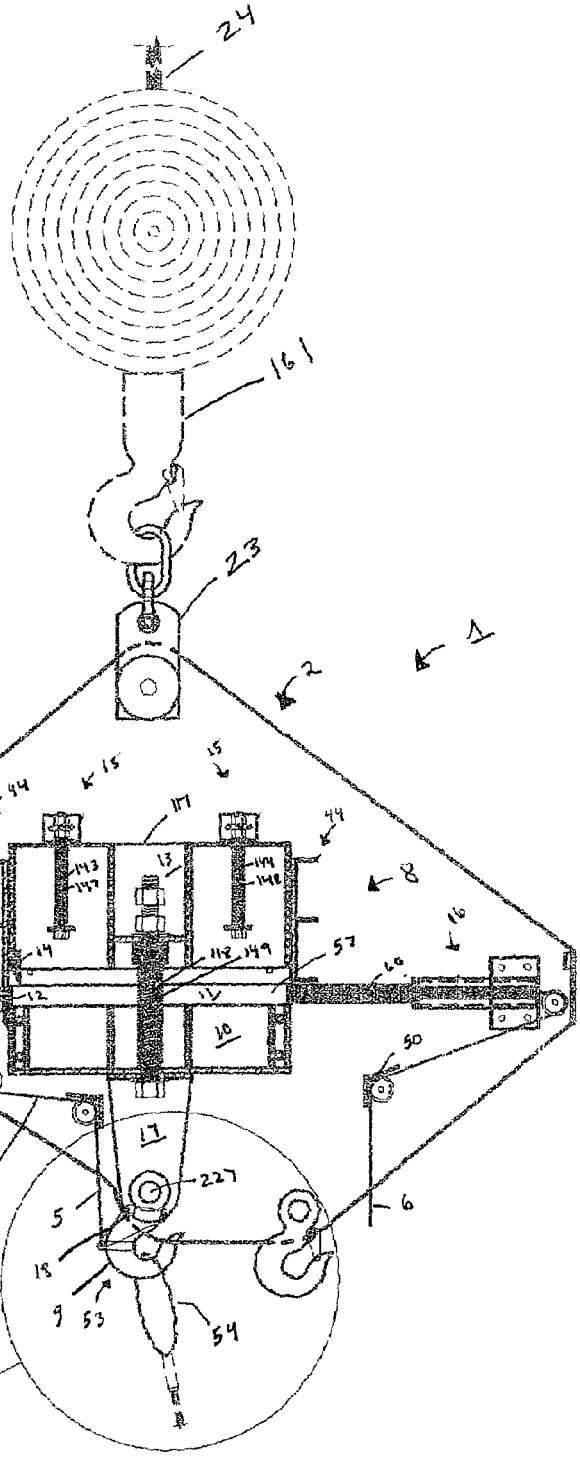
FIG. 14 is a view of a preferred embodiment of the invention with the front plate of the housing removed, illustrating the positions of the various elements relative to one another when the hook is ready to receive a load.
Figure 14A:
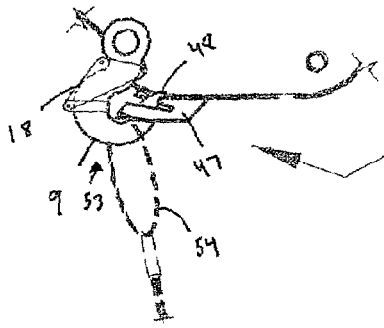
FIG. 14A is an enlarged view of the circled area of FIG. 14, depicting the hook engaged to the guard latch.

Turning now to FIGS. 6 and 13, in a preferred embodiment, load-engaging member 3 comprises a standard hook 53 well known in the industry, and load 7 to be lifted/transported is attached to hook 53 via rigging components conventional in the industry, such as slings 54 or chains. Hook 53 provides for a universal application as hook 53 may be utilized with slings and hardware of various sizes and weights, thereby allowing for a greater variation in the rigging components that can be used in load lift operations. Hook 53 further comprises an interior section 55 and a mouth 56 which provides access to interior section 55. In addition, hook 53 further comprises tip end 48 designed to be inserted through slotted opening 190 of guard latch plate 47 within housing 2, as shown in FIGS. 2A, 5, and 14A. This prevents lifting sling 54 from sliding off tip end 48 of hook 53 when sling 54 is first applied to hook 53, this guard latch 47 feature of the invention thereby maintaining the safety and integrity of lifting sling 54 and hardware. When load 7 is then applied to sling 54, the downward weight of load 7 causes tip end 48 of hook 53 to become disengaged from guard latch plate 47, yet at this point, the weight of lifted load 7 is sufficient to keep sling 54 from slipping off tip end 48 of hook 53.

Figure 15:
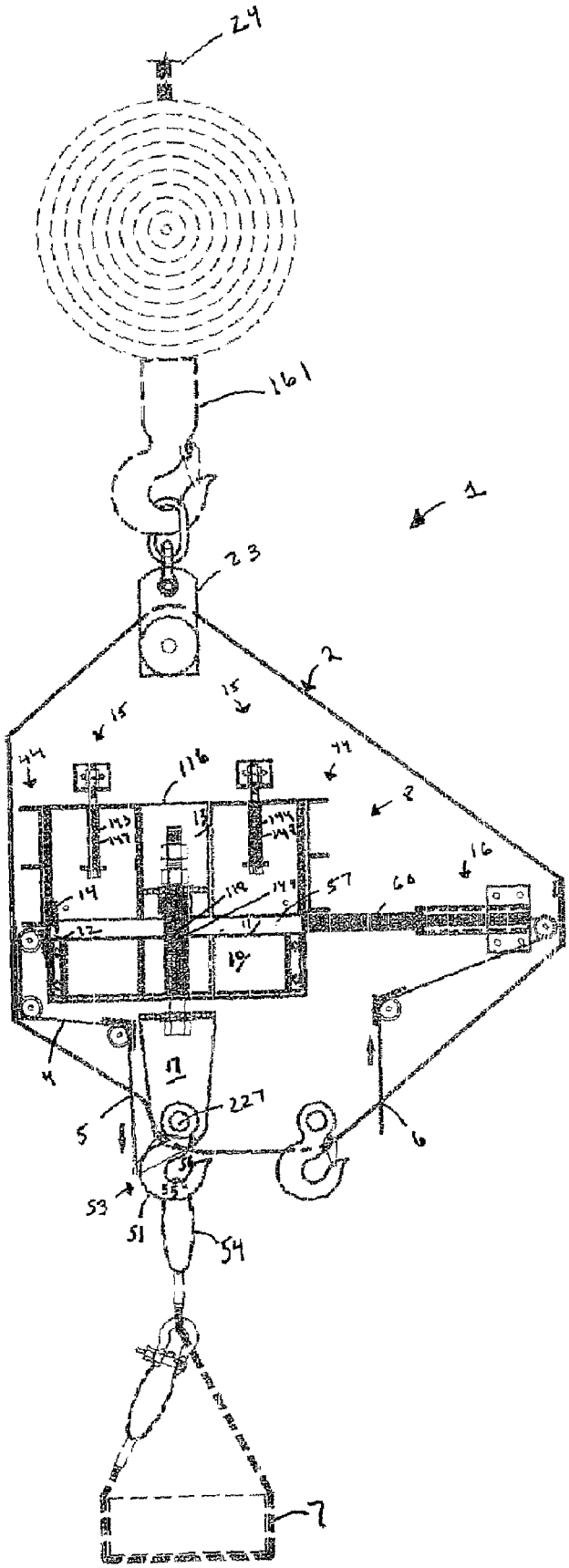
FIG. 15 is a view of a preferred embodiment of the invention with the front plate of the housing removed, illustrating the positions of the various elements relative to one another when the load has been attached to the hook via a sling.
Figure 16:
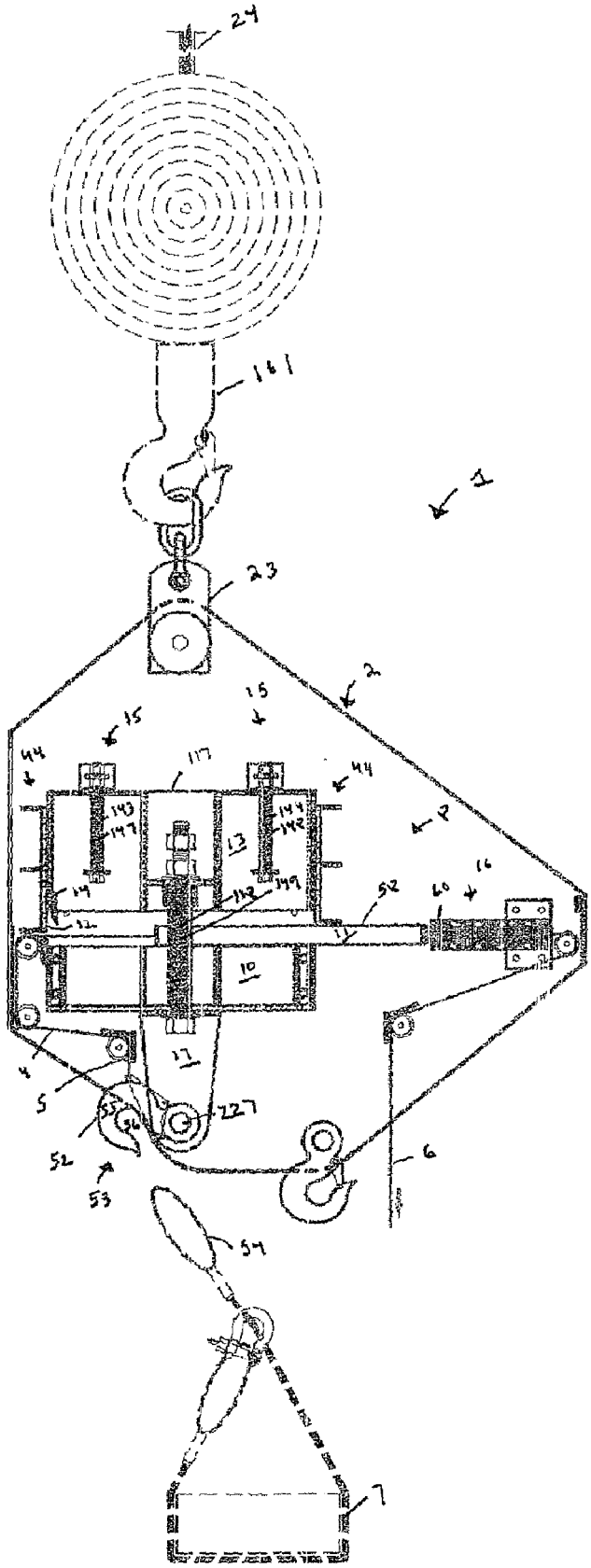
FIG. 16 is a view of a preferred embodiment of the invention with the front plate of the housing removed, illustrating the positions of the various elements relative to one another when the load has been transported to the desired location and positioned at the final anchor location and released.

In a preferred embodiment, hook 53 has safe position 9, a loaded position 51, and a released position 52, hook 53 being configured to pivot between loaded position 51 and released position 52. As shown in FIGS. 14 and 14A, hook 53 is in safe position 9 when tip end 48 of hook 53 is inserted through slotted opening 190 of guard latch plate 47 within housing 2. As shown in FIG. 15, hook 53 is in loaded position 51 when mouth 56 of hook 53 is situated between housing 2 and interior section 55 of hook 53. As shown in FIG. 16, hook 53 is in released position 52 when interior section 55 of hook 53 is at least about level with mouth 56, or when interior section 55 is above mouth 56.

As shown in FIGS. 1 and 2, cable 4 of apparatus 1 includes a load end 5 operatively attached to hook 53 via bracket assembly 18, as further discussed below. Cable 4 further includes a control end 6, situated outside housing 2, for unlatching load 7 attached to hook 53. In a preferred embodiment, cable 4 has a first position 57, as shown in FIGS. 14 and 15, and a second position 58, as shown in FIG. 16. Cable 4 is configured so that when a linear force is exerted on control end 6 of cable 4, cable 4 is moved from first position 57, as shown in FIGS. 14 and 15, to second position 58, as shown in FIG. 16. Cable 4 is further configured so that a linear force exerted on control end 6 of cable 4 is also transmitted to bracket assembly 18, which then pivots hook 53 from loaded position 51, as shown in FIG. 15, to released position 52, as shown in FIG. 16. Thus, cable 4 and hook 53 are configured such that when a linear force is exerted on control end 6 of cable 4, cable 4 is moved from first position 57 to second position 58, whereby hook 53 is moved from loaded position 51 to released position 52. In a preferred embodiment, cable 4 is biased against movement into second position 58 such that when the linear force exerted upon control end 6 ceases, cable 4 returns to first position 57, allowing hook 53 to pivot to loaded position 51 via gravity. This bias can be achieved via line transfer compression spring assembly 16 affixed to line transfer bar member 11 which, in turn, is affixed to cable 4 between load end 5 and control end 6.

Figure 10A:
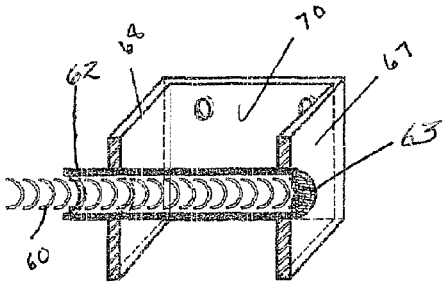
FIG. 10A is a cross sectional view of the line transfer compression spring assembly taken along section lines 10A—10A of FIG. 10.
Figure 10:
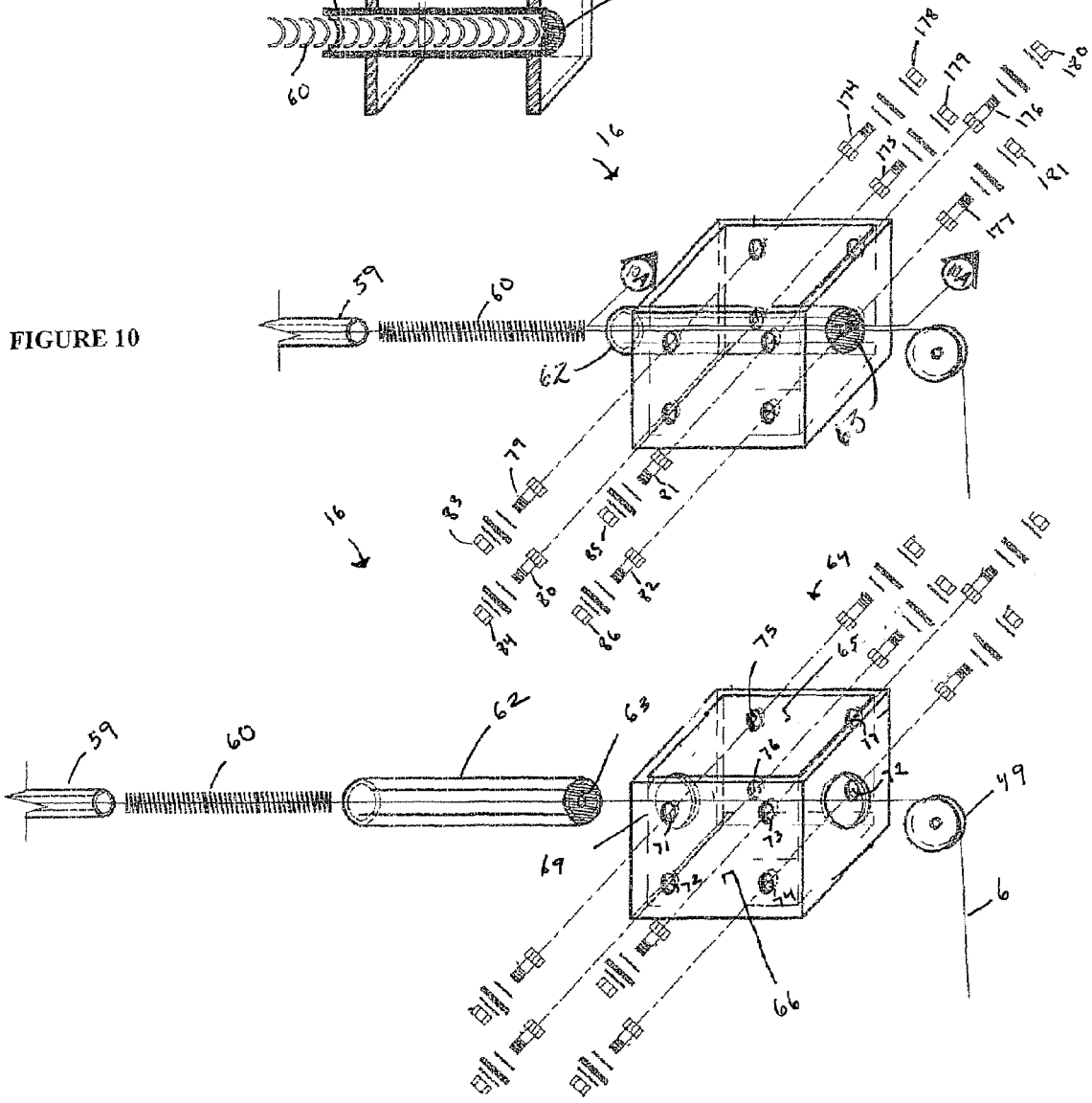
FIG. 10 is a three-quarter perspective and partial exploded view of the line transfer compression spring assembly.

As shown in FIGS. 6, 10, and 10A, line transfer compression spring assembly 16 includes a tubular insert guide member 59 operatively attached to extremity of line transfer bar member 11. Line transfer bar member 11, in turn, is affixed to cable 4 and is configured to slidably move within housing 2 with cable 4 from first position 57, as shown in FIGS. 14 and 15, to second position 58, as shown in FIG. 16. Turning now to FIGS. 10 and 10A, tubular insert guide member 59 attached to line transfer bar member 11 is hollow and includes a biasing spring 60 running through length of tubular insert guide member 59. Biasing spring 60 should be positioned and configured to be compressed, or alternatively, expanded, as cable 4 and line transfer bar member 11 are moved from first position 57 to second position 58, upon the application of a linear force to control end 6 of cable 4. When the linear force on control end 6 of cable 4 ceases, biasing spring 60 should relax and return cable 4 and line transfer bar member 11 to first position 57, allowing hook 53 to pivot to loaded position 51 via gravity. Thus, in this fashion, biasing spring 60 of line transfer compression spring assembly 16 biases cable 4 against movement into second position 58 and tubular insert guide member 59 serves to guide spring 60 upon its compression/or expansion and subsequent relaxation. In a preferred embodiment, line transfer spring assembly 16 further comprises a sleeve member 62 having an end plate 63, sleeve member 62 being positioned to receive tubular insert guide member 59 containing biasing spring 60. Sleeve member 62 and end plate 63 are configured to check the compression/or expansion of spring 64 upon application of linear force to control end 6 of cable 4. Sleeve member 62, in turn, extends into a spring sleeve anchor box 64, where it ultimately affixed. Spring sleeve anchor box 64 is hollow and generally square in shape and comprises a top plate 65, a bottom plate 66, two end plates 67 and 68, a front plate 69 and a back plate 70. Front plate 69 and back plate 70 of spring sleeve anchor box 64 are in parallel alignment with front plate 19 and back plate 20 of housing 2, respectively, and back plate 70 of spring sleeve anchor box 64 is bolted to interior surface 163 of back plate 20 of housing 2, as depicted in FIG. 5, and as further described below.

As shown in FIG. 10, front plate 69 of spring sleeve anchor box 64 has four openings 71, 72, 73, and 74 in alignment with four openings 75, 76, 77 and 78 provided to back plate 70 of spring sleeve anchor box 64. Front plate 19 and back plate 20 of housing 2 are both provided with openings corresponding to those given front plate 69 and back plate 70 of spring sleeve anchor box 64, respectively. Bolts 79, 80, 81, and 82, having sufficient diameter and length to extend through openings 71, 72, 73, 74 of front plate 69 are driven through front plate 19 of housing 2 and front plate 69 of spring sleeve anchor box 64. Bolts 79, 80, 81, and 82 are secured via lock nuts 83, 84, 85, and 86 respectively. Bolts 174, 175, 176, and 177, having sufficient diameter and length to extend through openings 75, 76, 77, and 78 of back plate 70 are driven through back plate 70 of spring sleeve anchor box 64 and back plate 20 of housing 2. Bolts 174, 175, 176, and 177 are secured via lock nuts 178, 179, 180, and 181, respectively. Thus, spring sleeve anchor box 64 provides another point of attachment for front plate 19 and back plate 20 of housing 2 that maintains their parallel integrity.

As mentioned above, and as shown in FIG. 6, apparatus 1 further comprises load-activated lock 8 having upper floating anchor box 13, line transfer bar member 11, and fixed lower box 10, these embodiments discussed in further detail below.

Figure 11A:
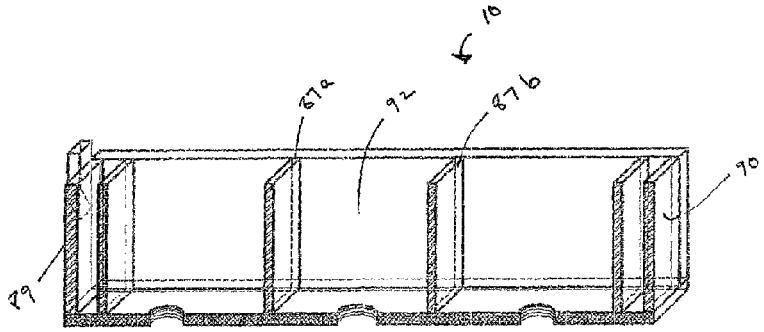
FIG. 11A is a cross sectional view of the fixed lower box taken along section lines 11A—11A of FIG. 11.
Figure 11:
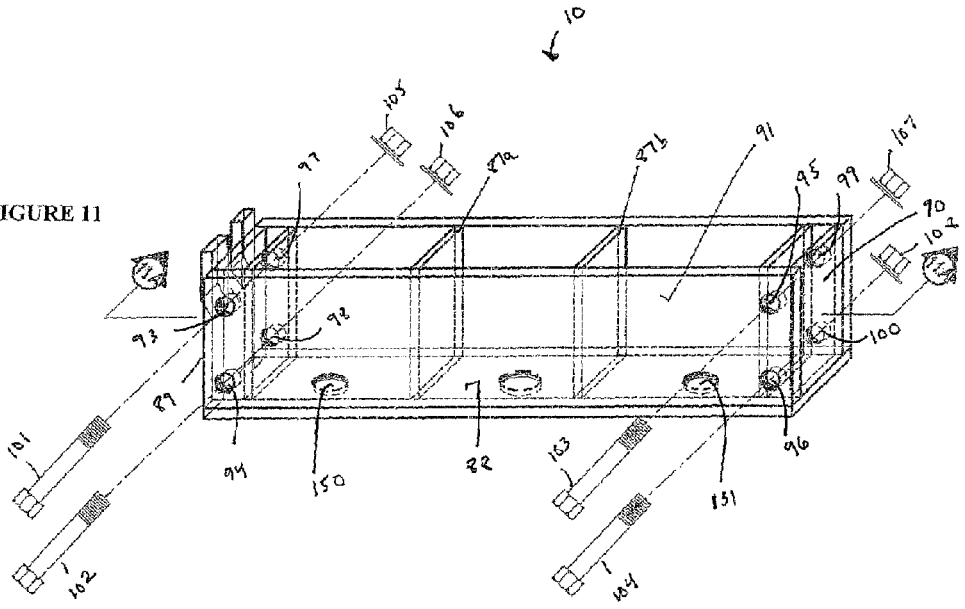
FIG. 11 is an isometric exploded view of the fixed lower box of the load-activated lock.

Turning now to FIGS. 11 and 11A, fixed lower box 10, is generally hollow and rectangular in shape. Fixed lower box 10 comprises a bottom plate 88, two end plates 89 and 90, a front plate 91 and a back plate 92. Fixed lower box 10 is further provided with two stiffener plates 87*a* and 87*b* situated within fixed lower box 10 that maintain the rigidity of fixed lower box 10. Front plate 91 and back plate 92 of fixed lower box 10 are in parallel alignment with front plate 19 and back plate 20 of housing 2, respectively, with back plate 92 of fixed lower box 10 being bolted to interior surface 163 of back plate 20 of housing 2, as depicted in FIG. 5. As shown in FIG. 11, front plate 91 of fixed lower box 10 has four openings 93, 94, 95 and 96 in alignment with four openings 97, 98, 99, and 100 provided to back plate 92 of fixed lower box 10. Front plate 19 and back plate 20 of housing 2 are both provided with openings corresponding to those given front plate 91 and back plate 92 of fixed lower box 10. Bolts 101, 102, 103, and 104 having sufficient diameter and length to extend through openings 93, 94, 95, 96, 97, 98, 99, and 100, are extended through front plate 19 of housing 2, front plate 91 and back plate 92 of fixed lower box 10, and back plate 20 of housing 2, respectively. Bolts 101, 102, 103, and 104 are secured via lock nuts 105, 106, 107, and 108, respectively. Thus, fixed lower box 10 provides another point of parallel attachment for front plate 19 and back plate 20 of housing 2.

As shown in FIG. 6, load-activated lock 8 also includes line transfer bar member 11 which is configured to rest and slide along the edges of front plate 91 and back plate 92 of fixed lower box 10. As discussed above, line transfer bar member 11 is affixed to cable 4 between control end 6 and load end 5, and is configured to move within housing 2 with cable 4 from first position 57, as shown in FIGS. 14 and 15, to second position 58, as shown in FIG. 16. As also discussed previously, and as shown in FIG. 6, line transfer bar member 11 serves as an attachment point for line transfer compression spring assembly 16 which biases cable 4 and line transfer bar member 11 against movement into second position 58. As will be described further below, line transfer bar member 11 also serves as a base for upper floating anchor box 13 to engage with to secure cable 4 and line transfer bar member 11 in first position 57. Line transfer bar member 11 comprises two end plates, 167 and 168, a front plate 169, and a back plate 170. Line transfer bar member 11 is further provided with a stiffener plate 165 situated within line transfer bar member 11 to maintain the rigidity of line transfer bar member 11. Line transfer bar member 11 is preferably hollow and rectangular in shape and has locking cavity 12 situated at interior surface 171 of end plate 167. Locking cavity 12 is designed to be in engagement with locking plates 14 of upper floating anchor box 13, as further discussed below.

Figure 8A:
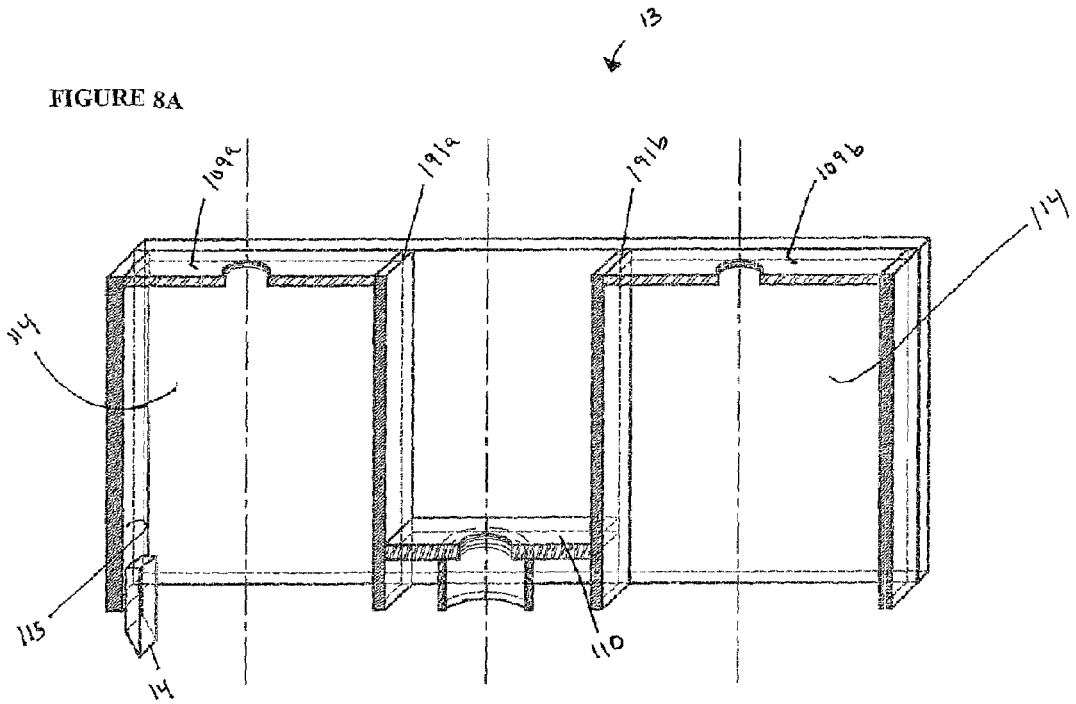
FIG. 8A is cross sectional view of the upper floating anchor box taken along section lines 8A—8A of FIG. 8.
Figure 8:
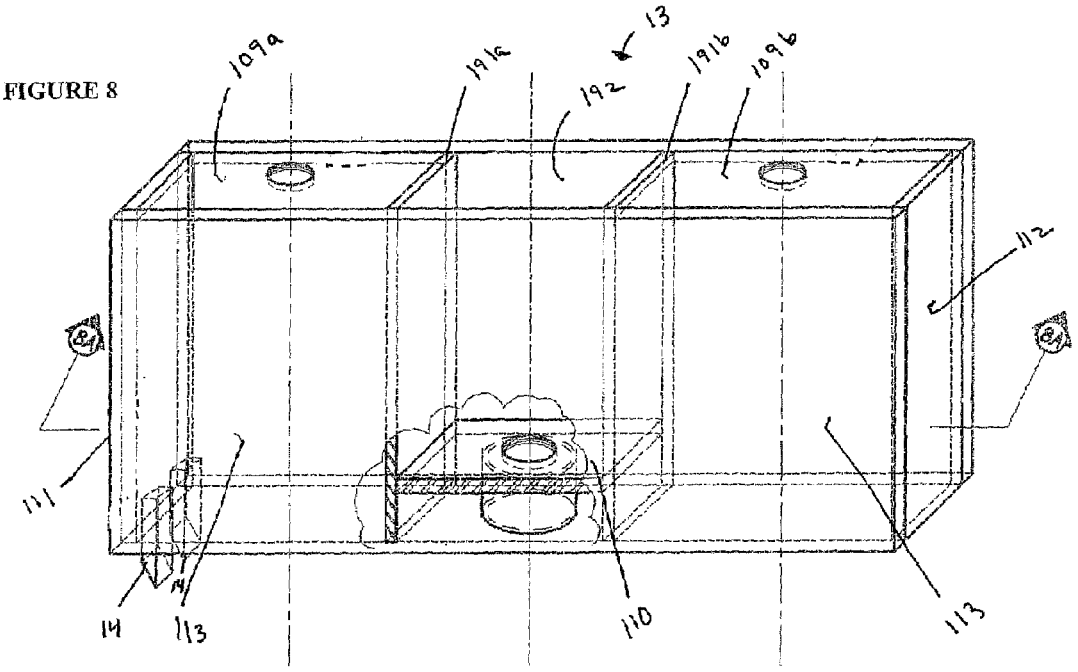
FIG. 8 is a three-quarter perspective view of the upper floating anchor box of the load-activated lock.
Figure 9A:
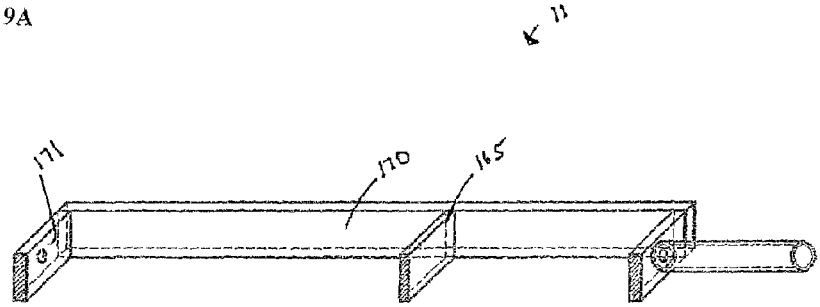
FIG. 9A is a cross sectional view of the line transfer bar member taken along section lines 9A—9A of FIG. 9.
Figure 9:
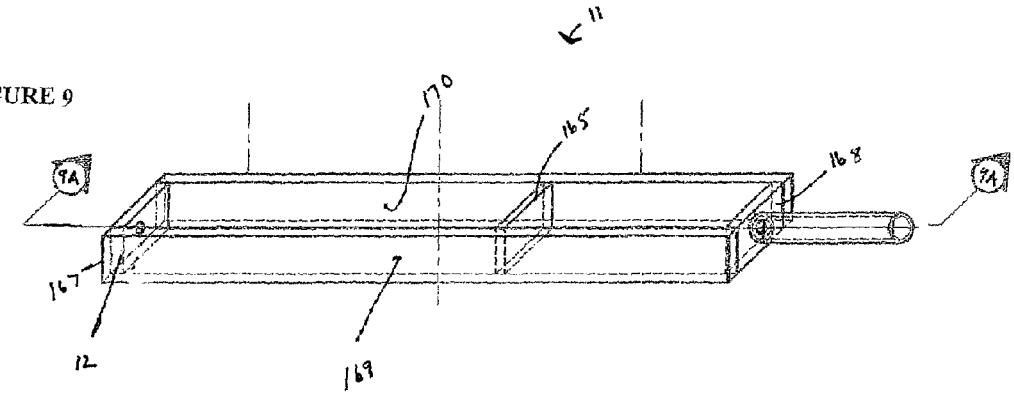
FIG. 9 is a three-quarter perspective view of the line transfer bar member of the load-activated lock.

As shown in FIG. 6, load-activated lock 8 also includes upper floating anchor box 13 which is configured to rest independently on line transfer bar member 11. Turning now to FIGS. 8 and 8A, upper floating anchor box 13 is generally rectangular in shape, and comprises two top plates 109*a* and 109*b* separated by an aperture 192, two end plates, 111 and 112, a front plate 113 and a back plate 114. Front plate 113 and back plate 114 of upper floating anchor box 13 are in parallel alignment with front plate 19 and back plate 20 of housing 2, respectively. Upper floating anchor box 13 is further provided with two stiffener plates 191*a* and 191*b* situated within upper floating anchor box 13 to maintain the rigidity of upper floating anchor box 13. Upper floating anchor box 13 is further provided with a plate 110 situated toward the lower extremity of upper floating anchor box 13. Plate 110 is welded to stiffener plates 191*a* and 191*b*, and front and back plates 113 and 114 of upper floating anchor box 13, and is designed to contain a bolt 118, as further described below. Upper floating anchor box 13 further comprises locking plates 14 affixed to interior wall surface 115 of end plate 111, locking plates 14 being designed to engage locking cavity 12 of line transfer bar member 11. In a preferred embodiment, upper floating anchor box 13 has a locked position 116, as depicted in FIG. 15, and an unlocked position 117, as depicted in FIGS. 14 and 16. As shown in FIGS. 6, 14, 15, and 16, upper floating anchor box 13 is in mechanical communication with hook 53 so that when the vertical force of lifted load 7 is applied to hook 53, this force is also transmitted to upper floating anchor box 13 to move it from unlocked position 117 to locked position 116. In a preferred embodiment, upper floating anchor box 13 is in mechanical communication with hook 53 via a bolt 118 housed in plate 110, bolt 118 being operatively secured within upper floating anchor box 13 via lock nut 164. As shown in FIG. 6, bolt 118 should be configured to run vertically through upper floating anchor box 13, line transfer bar member 11, lower box 10, and hook plate assembly 18, respectively, so that when a vertical force is applied to hook 53, bolt 118 pulls upper floating anchor box 13 toward line transfer bar member 11, whereby locking plates 14 within upper floating anchor box 13 lockingly engage locking cavity 12 of line transfer bar member 11, when cable 4 and line transfer bar member 11 are in first position 57. Plate 110 housing bolt 118 is configured and positioned to brace bolt 118 and provide a central axis so that when vertical force is applied to hook 53, bolt 118 pulls upper floating anchor box 13 downward in a stable and linear fashion. Furthermore, vertical 'E' shaped brackets 45 and 46, situated adjacent to upper floating anchor box 13, as described above, also guide upper floating anchor box 13 for a proper engagement with line transfer bar member 11. Thus, as shown in FIG. 15, when upper floating anchor box 13 is in locked position 116, locking plates 14 of upper floating anchor box 13 engage locking cavity 12 of line transfer bar member 11 to secure cable 4 and line transfer bar member 11 in first position 57. In unlocked position 117, as shown in FIGS. 14 and 16, locking plates 14 of upper floating anchor box 13 disengage locking cavity 12 of line transfer bar member 11, whereby cable 4 and line transfer bar member 11 are released and may be freely moved between first position 57 and second position 58 upon application of linear force to control end 6 of cable 4. However, when upper floating anchor box 13 is in locked position 116, any linear force exerted on control end 6 of cable 4 that would otherwise move cable 4 and line transfer bar member 11 from first position 57 to second position 58 and would thereby move hook 53 from loaded position 51 to released position 52 will be opposed by the engagement of upper floating anchor box 13 to cable 4 via line transfer bar member 11. Therefore, if control end 6 of cable 4 is accidentally or inadvertently pulled when load 7 is suspended from hook 53, the engagement of upper floating anchor box 13 with line transfer bar member 11 will prevent hook 53 from pivoting to released position 52 and thereby releasing load 7 prematurely. Thus, the lock mechanism of the invention is designed to provide optimum safety for both personnel and equipment during load-lift operations.

In a preferred embodiment, upper floating anchor box 13 is biased against movement from unlocked position 117 to locked position 116, so that when load 7 is released from hook 53, upper floating anchor box 13 will return to unlocked position 117, whereby cable 4 and line transfer bar member 11 will then be free to be moved from first position 57 to second position 58 by the application of a linear force to control end 6 of cable 4. This bias can be achieved by leveler/spring assembly 15, which both provides a point of attachment for plates 19 and 20 of housing 2 and biases upper floating anchor box 13 against movement from unlocked position 117 to locked position 116, as discussed below.

Figure 7:
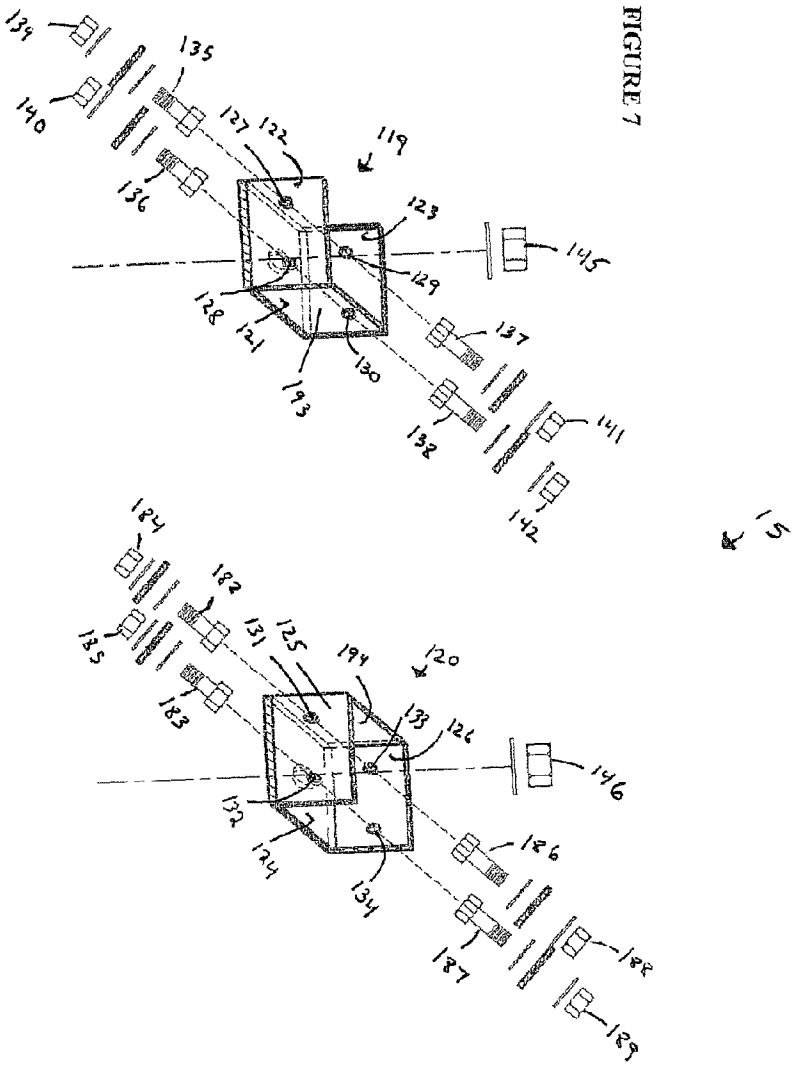
FIG. 7 is a three-quarter perspective and partial exploded view of the leveler assembly.

As shown in FIGS. 6, and 7, leveler assembly 15 includes a pair of brackets 119 and 120 situated on top plates 109*a* and 109*b*, respectively of upper floating anchor box 13. Bracket 119 has a base 121, a front plate 122, a side plate 193, and a back plate 123. Front plate 122 and back plate 123 of bracket 119 are in parallel alignment with front plate 19 and back plate 20 of housing 2. Bracket 120 also has a base 124, a front plate 125, a side plate 194, and a back plate 126. Front plate 125 and back plate 126 of bracket 120 are also in parallel alignment with front plate 19 and back plate 20 of housing 2. Back plate 123 of bracket 119 and back plate 126 of bracket 120 are bolted to interior surface 163 of back plate 20 of housing 2, as depicted in FIG. 5. As shown in FIG. 7, front plate 122 of bracket 119 has two openings 127 and 128 in alignment with two openings 129 and 130 provided to back plate 123 of bracket 119. Front plate 125 of bracket 120 also has two openings 131 and 132 in alignment with two openings 133 and 134 provided to back plate 126 of bracket 120 corresponding to those given front plate 122 and back plate 123 of bracket 119 and to those given front plate 125 and back plate 126 of bracket 120. Bolts 135 and 136 having sufficient diameter and length to extend through openings 127 and 128 of front plate 122 are driven through front plate 19 of housing 2 and front plate 122 of bracket 119 respectively, and are secured via lock nuts 139 and 140, respectively. Bolts 137 and 138 having sufficient diameter and length to extend through openings 129 and 130 of back plate 123 are driven through back plate 123 of bracket 119 and back plate 20 of housing 2, respectively, and are secured via lock nuts 141 and 142, respectively. Bolts 182 and 183, having sufficient diameter and length to extend through openings 131 and 132 of front plate 125 are driven through front plate 19 of housing 2 and front plate 125 of bracket 120, respectively, and are secured via lock nuts 184 and 185, respectively. Bolts 186 and 187 having sufficient diameter and length to extend through openings 133 and 134 of back plate 126 are driven through back plate 126 of bracket 120 and back plate 20 of housing 2, respectively, and are secured via lock nuts 188 and 189, respectively. Thus, leveler assembly 15 provides another point of parallel attachment for front plate 19 and back plate 20 of housing 2.

Leveler assembly 15 also serves to bias upper floating anchor box 13 against movement from unlocked position 117 to locked position 116. As shown in FIGS. 6 and 7, this is achieved by extending two bolts 143 and 144 through bases 121 and 124 of brackets 119 and 120, respectively. Bolts 143 and 144 are then secured via lock nuts 145 and 146. Bolts 143 and 144 extend into upper floating anchor box 13 and operatively join upper floating anchor box 13 to brackets 119 and 120 of leveler assembly 15. The biasing is then achieved by providing bolts 143 and 144 with biasing springs 147 and 148, slidably disposed about bolts 143 and 144, respectively. If additional biasing means are desired, then bolt 118, which serves as a mechanical communication between upper floating anchor box 13 and hook 53, may also be provided with a biasing spring 149. Biasing springs 147, 148, and 149 should be positioned and configured to be compressed, or alternatively expanded, as upper floating anchor box 13 is moved from unlocked position 117 to locked position 116 by the application of load 7 to hook 53, as depicted in FIG. 15. In a preferred embodiment, bottom plate 88 of fixed lower box 10, is provided with two openings 150 and 151 through which tension of biasing springs 147 and 148 may be adjusted. The amount of tension in biasing springs 147 and 148 will determine the weight of load 7 necessary to pull upper floating anchor box 13 toward line transfer bar member 11 for a locking engagement that will secure cable 4 and line transfer bar member 11 in first position 57. This adjustable tension feature of load-activated lock 8 allows lock 8 to accommodate the weight of slings 54 and hardware utilized to attach load 7 to apparatus 1, so that only the application of the desired load weight to hook 53 will trigger upper floating anchor box 13 to move from unlocked position 117 to locked position 116 and a premature locking will thereby be avoided. When load 7 is released from hook 53, biasing springs 147, 148, and 149 should then relax and return upper floating anchor box 13 to unlocked position 117, freeing cable 4 and line transfer bar member 11 to be moved to second position 58, as depicted in FIG. 16. Thus, in this fashion, biasing springs 147, 148, and 149 maintain upper floating anchor box 13 in unlocked position 117 when there is no load 7 on hook 53. At this point, control end 6 of cable 4, situated outside of housing 2, may be pulled in a vertical fashion. Alternatively, cable 4 may be pulled in a horizontal fashion by extending cable 4 outward through slotted opening 22 of horizontal end plate 21. Upon application of linear force to control end 6, cable 4 and line transfer bar member 11 are moved to second position 58, whereby hook 53 is then moved to released position 52, causing sling 54, via which load 7 is attached to hook 53, to be quickly and efficiently released from hook 53. Thus, as there is no need for personnel to travel to the top of lifted load 7 to detach sling 54, the release mechanism of the invention is designed to reduce the amount of work needed to be performed at elevations above ground level, where there is risk of fall hazards. This, in turn enhances safety and reduces the time and cost concerns associated with such load-lift operations.

Figure 12:
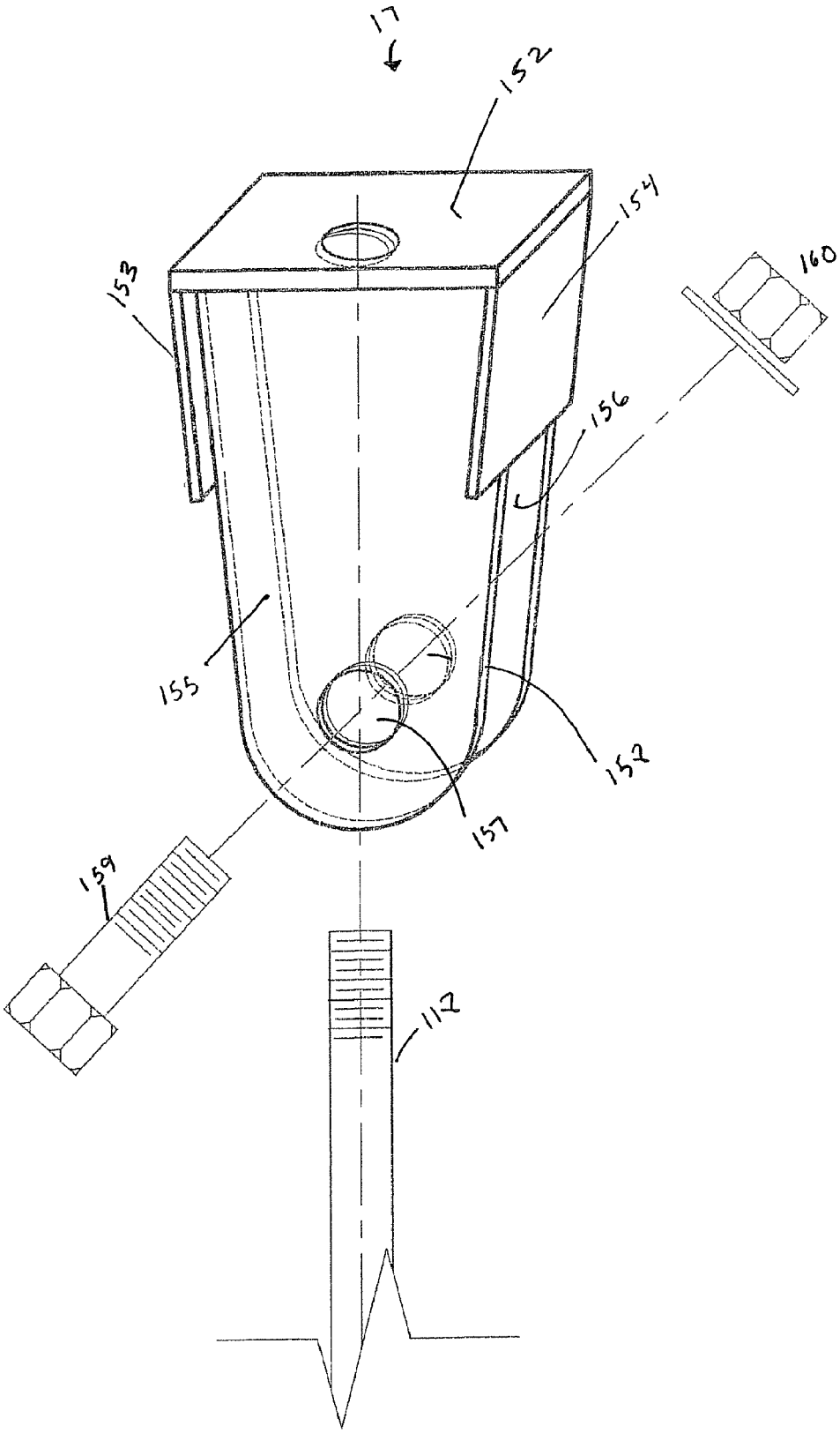
FIG. 12 is an isometric exploded view of the hook plate assembly.

As shown in FIGS. 6 and 12, apparatus 1 of this invention, further includes hook plate assembly 17. Hook plate assembly 17 is situated beneath fixed lower box 10 and comprises a top plate 152, two end plates 153, 154, a front plate 155 and a back plate 156. Front plate 155 and back plate 156 of hook plate assembly 17 are in parallel alignment with front plate 19 and back plate 20 of housing 2, respectively. Front plate 155 of hook plate assembly 17 has opening 157 in alignment with opening 158 provided to back plate 156 of hook plate assembly 17. Bolt 159 of sufficient diameter and length to extend through openings 157 and 158 is driven through front plate 155 and back plate 156 of hook plate assembly 17 and is secured via lock nut 160. As shown in FIGS. 14, 15, and 16, hook 53 is affixed to hook plate assembly 17 at hinge point 227.

As shown in FIGS. 6, and 13, apparatus 1 further includes bracket assembly 18. Bracket assembly 18 comprises triangular shaped plate 199 affixed to a collar member 198. As depicted in FIGS. 13, 14, 15, and 16, triangular shaped plate 199 has three attachment points 195, 196, and 197. At point 195, triangular shaped plate 199 is affixed to front plate 155 of hook plate assembly 17. At point 196, triangular shaped plate 199 is attached to hook 53. At point 197 triangular shaped plate 199 is attached to collar member 198, collar member 198 being ultimately affixed to hook 53. Point 197 is also an attachment point for load end 5 of cable 4 to thereby provide a hinge point for triangular shaped plate 199. As shown in FIG. 16, bracket assembly 18 functions as follows. When a linear force is applied to control end 6 of cable 4, hook 53 pivots at hinge point 227 to move toward released position 52. Triangular shaped plate 199 of bracket assembly 18 then provides a lever arm at hinge point 197 to facilitate the pivoting of hook 53, from loaded position 51 to released position 52.

Figure 17:
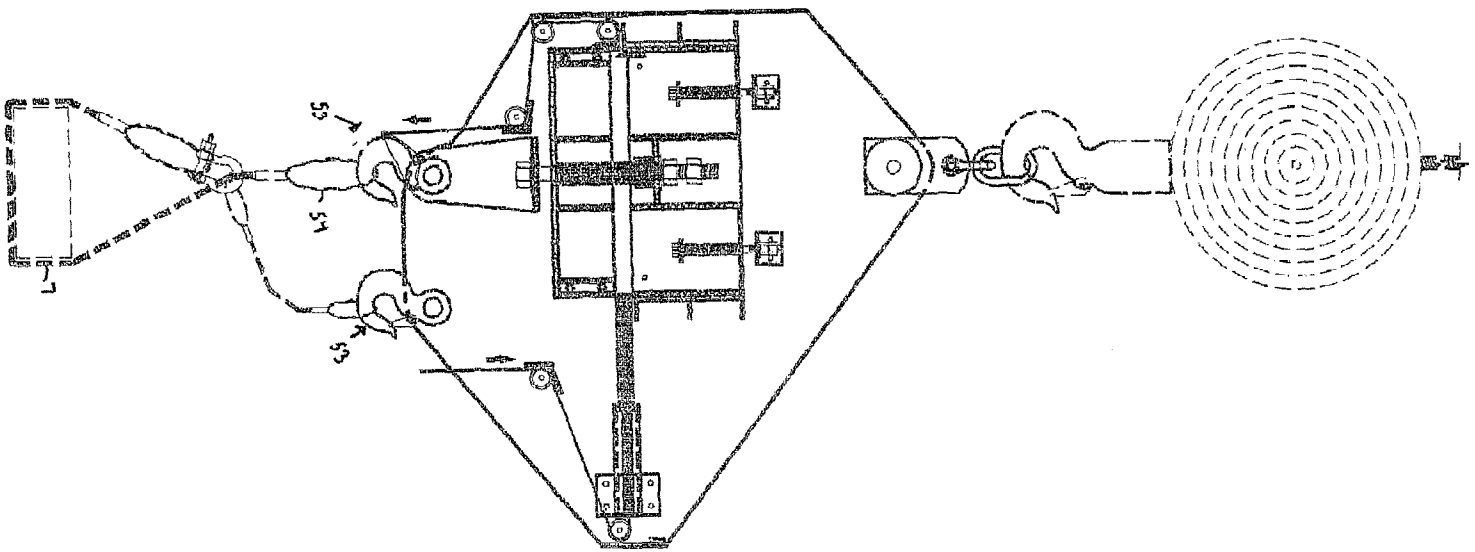
FIGS. 17 and 18 are views of another preferred embodiment of the invention with the front plate of the housing removed, depicting the utilization of a second hook in load lift operations.
Figure 18:
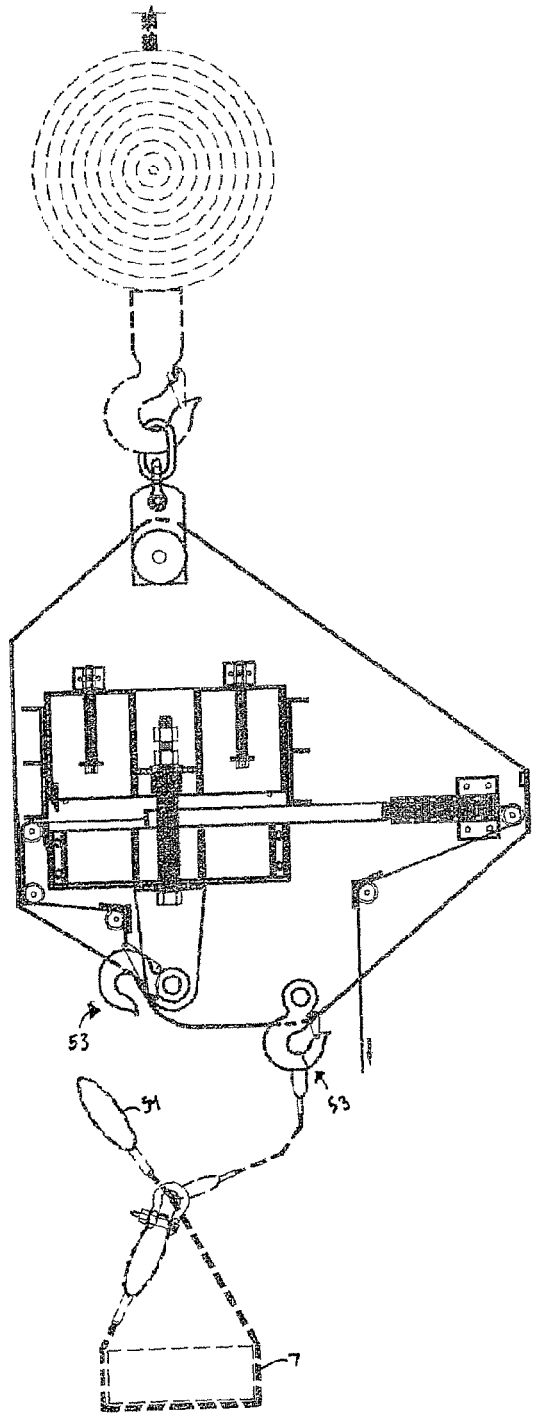

In another preferred embodiment, and as depicted in FIGS. 17 and 18, apparatus 1 comprises a second load-engaging member 3, also preferably a hook 53 conventional in the industry. The two-hook system of apparatus 1 affords various advantages that provide for an improved apparatus 1. For example, if two hooks 53 are utilized, as opposed to one, then the weight of lifted load 7 is distributed across hooks 53, thereby resulting in an apparatus 1 that has an increased capacity to lift greater weight. Furthermore, should the conventional cradle hitch rigging method be used, one hook 53 can then serve as a releasing mechanism for both load slings 54, whereby slings 54 can then be easily retrieved via a strip choker, well know in the art. In addition, the two-hook system of loading apparatus 1 affords an inherent separation feature in that it prevents load slings 54 from entangling, thereby providing for a safer and more efficient load lift operation.

FIG. 14 illustrates the positions of the various elements of the invention relative to one another when hook 53 is ready to receive load 7. In this position, housing 2 of the invention is operatively attached to a crane hook 161, crane hook 161 being ultimately affixed to crane lift line 24. Sling 54, via which load 7 is to be attached to hook 53, is then applied to hook 53. As depicted, hook 53 is in safe position 9, i.e. tip end 48 of hook 53 has been inserted into slotted opening 190 of guard latch plate 47 within housing 2 to prevent sling 54 from sliding off tip end 48. As also depicted in FIG. 14, cable 4 and line transfer bar member 11 are in first position 57 and upper floating anchor box 13 is in unlocked position 117.

FIG. 15 illustrates the positions of the various elements of the invention relative to one another when load 7 has been attached to hook 53 via sling 54. In this position, lifted load 7 is exerting a downward vertical force upon hook 53. This downward force causes tip end 48 of hook 53 to become disengaged from guard latch plate 47. As shown, hook 53 is now in loaded position 51. At this point only the weight of lifted load 7 upon hook 53 is necessary to prevent sling 54 from sliding off tip end 48 of hook 53. As shown, the force exerted on hook 53 is also being transmitted to upper floating anchor box 13, via bolt 118, whereby in locked position 116, locking plates 14 of upper floating anchor box 13 engage locking cavity 12 of line transfer bar member 11 to secure cable 4 and line transfer bar member 11 in first position 57. Therefore, at this point, if control end 6 of cable 4 were accidentally pulled, upper floating anchor box 13 will prevent cable 4 and line transfer bar member 11 from being moved to second position 58. This in turn will prevent hook 53 from being accidentally moved to released position 52 with cable 4 and thereby releasing load 7 prematurely.

FIG. 16 illustrates the position of the various elements of the invention relative to one another when load 7 has been transported to the desired location and positioned at the final anchor location for release. In this position, there is a cessation of the vertical load force upon hook 53. This in turn, allows biasing springs 147 and 148 of leveler spring assembly 15, and biasing spring 149, to return upper floating anchor box 13 to unlocked position 117, whereby cable 4 and line transfer bar member 11 are then free to be moved from first position 57 to second position 58. At this point, cable 4 may then be pulled in a vertical fashion or horizontal fashion. When control end 6 is pulled, cable 4 is moved to second position 58, whereby hook 53 is then moved to released position 52, causing sling 54 to be quickly and efficiently released from hook 53. When the linear force on control end 6 of cable 4 ceases, biasing spring 60 of line transfer compression spring assembly 16 should relax and return cable 4 and line transfer bar member 11 to first position 57, allowing hook 53 to pivot to loaded position 51 via gravity.

In an another alternative preferred embodiment, the invention further comprises a guard assembly 200. Guard assembly 200 is an additional feature designed to prevent the inadvertent release of sling 54 from hook 53. The first feature, guard latch plate 47, was discussed previously. As mentioned above, when sling 54 is first applied to hook 53, tip end 48 of hook 53 is inserted through slotted opening 190 of guard latch plate 47 to prevent sling 54 from sliding off tip end 48 of hook 53. When load 7 is then applied to hook 53 via sling 54, load 7 exerts a downward force upon hook 53, causing tip end 48 of hook 53 to become disengaged from guard latch plate 47, yet at this point, the weight of lifted load 7 is sufficient to keep sling 54 from slipping off tip end 48. In some circumstances, heavier slings, when first applied to hook 53 without load 7, may also cause tip end 48 of hook 53 to become disengaged from guard latch plate 47. In these instances, although the weight of sling 54 will prevent sling 54 from slipping off tip end 48 of hook 53 when hook is an upright position, the weight of sling 54 may also cause hook 53 to be pushed toward released position 52 prematurely, whereby sling 54 could then slide off tip end 48 of hook 53. Guard assembly 200 then is designed to prevent this possible problem.

Figure 19:
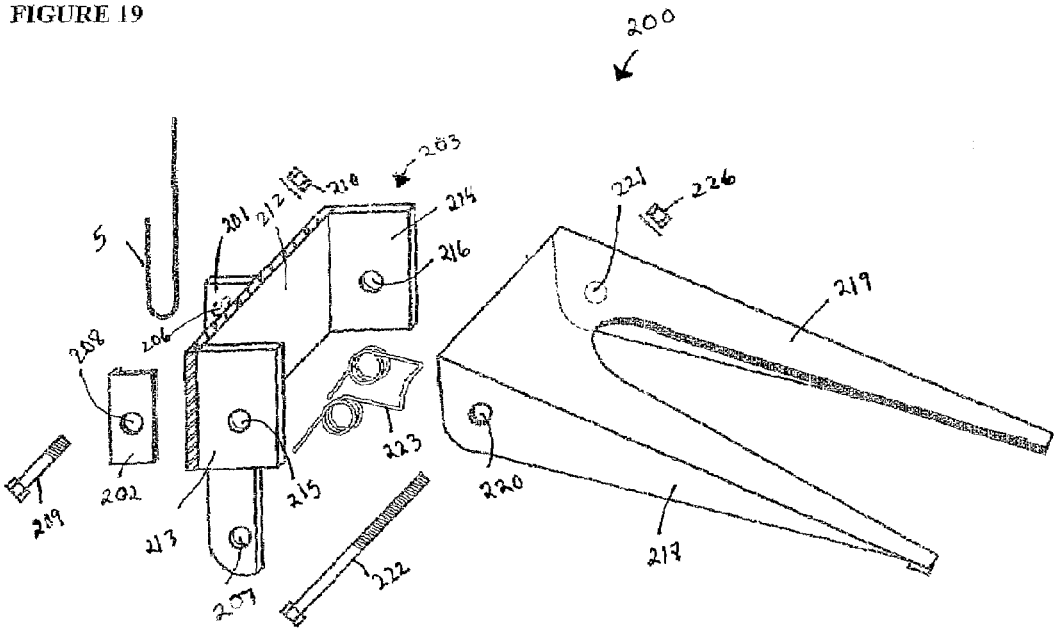
FIG. 19 is an exploded view of the guard assembly.
Figure 19A:
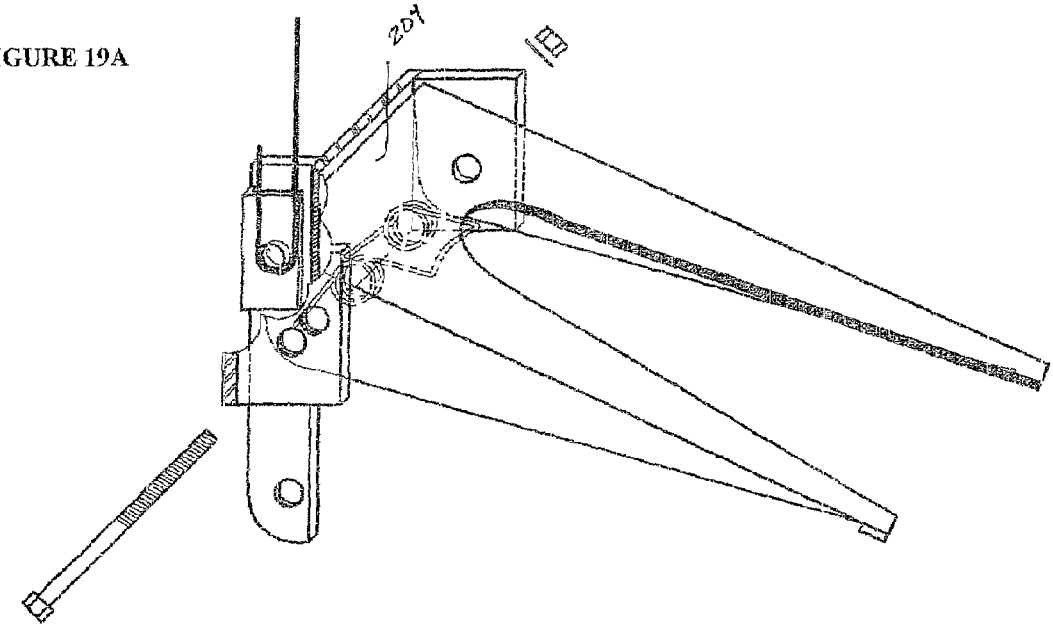
FIG. 19A depicts the assembly of the guard assembly.
Figure 22:
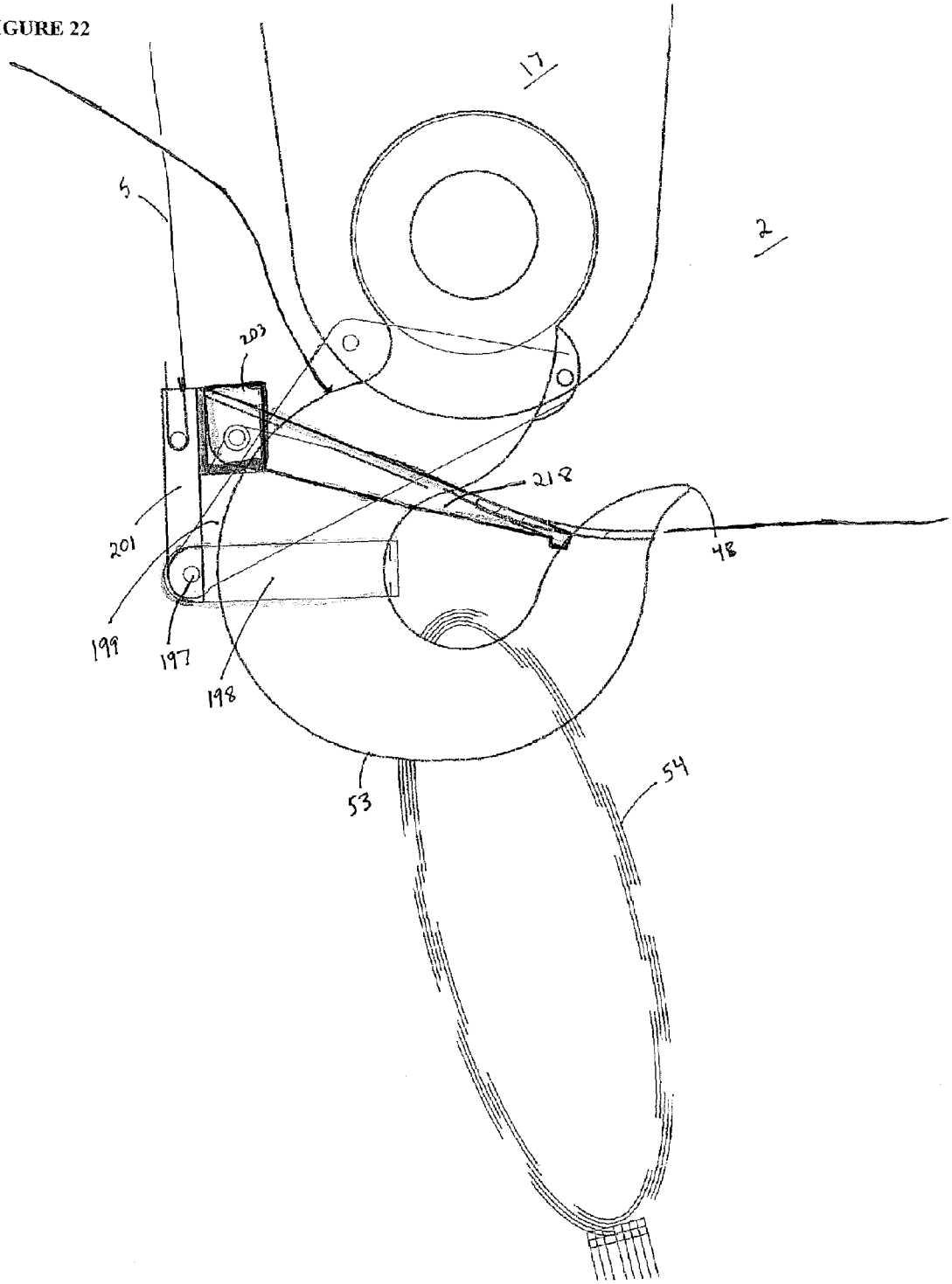
FIG. 22 is a view of a preferred embodiment of the invention, illustrating the positions of the various elements of the guard assembly when the hook is ready to receive a load.

As shown in FIGS. 19 and 19A, guard assembly 200 comprises a bar member 201, a clamp member 202, a bracket 203, and latch arms 218 and 219. Bar member 201 further comprises an opening 206 that is in alignment with opening 208 provided to clamp member 202. Bolt 209 of sufficient diameter and length is extended through opening 206 of bar member 201. Load engaging end 5 of cable 4 is then disposed about bolt 209. Clamp member 202 is then placed over bolt 209 so that bolt 209 extends through opening 208 of clamp member 202. Bolt 209, now extending through opening 206 of bar member 201 and opening 208 of clamp member 202, is then secured via nut 210 and thereby provides an anchor point for load engaging end 5 of cable 4. As shown in FIG. 22, lower extremity of bar member 201 is then affixed to collar member 198 and triangular shaped plate 199 of bracket assembly 18 at point 197 to provide an anchor point for guard assembly 200. Point 197 thereby provides a hinge point for both triangular shaped plate 199 of bracket assembly 18, as discussed above, as well as for bar member 201 of guard assembly 200.

In configuration, bar member 201 is then welded to back plate 212 of bracket 203. Bracket 203, in addition to having back plate 212, further comprises two end plates 213 and 214, with end plate 213 having an opening 215 in alignment with opening 216 of end plate 214. Bracket 203 is then affixed to latch arms 218 and 219 via a bolt 222, as discussed further below.

Latch arms 218 and 219 are held in position by back plate 204. Latch arm 218 has an opening 220 on its side that is in alignment with an opening 221 provided to latch arm 219. Latch arms 218 and 219 are situated inside bracket 203 so that openings 220 and 221 of latch arms 218 and 219 are in alignment with openings 215 and 216 of end plates 213 and 214, respectively, of bracket 203. Bolt 222 of sufficient diameter and length extends through opening 215 of end plate 213 of bracket 203, through opening 220 of latch arm 218, through opening 221 of latch arm 219, and through opening 216 of end plate 214 of bracket 203. Bolt 222 is secured via nut 226.

Figure 20:
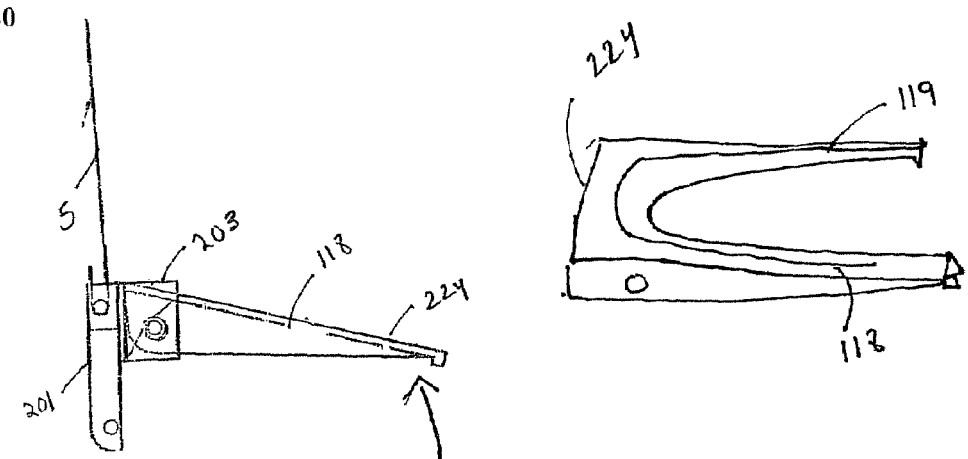
FIG. 20 is a view of a preferred embodiment of the invention depicting the latch arms in the open position.
Figure 21:
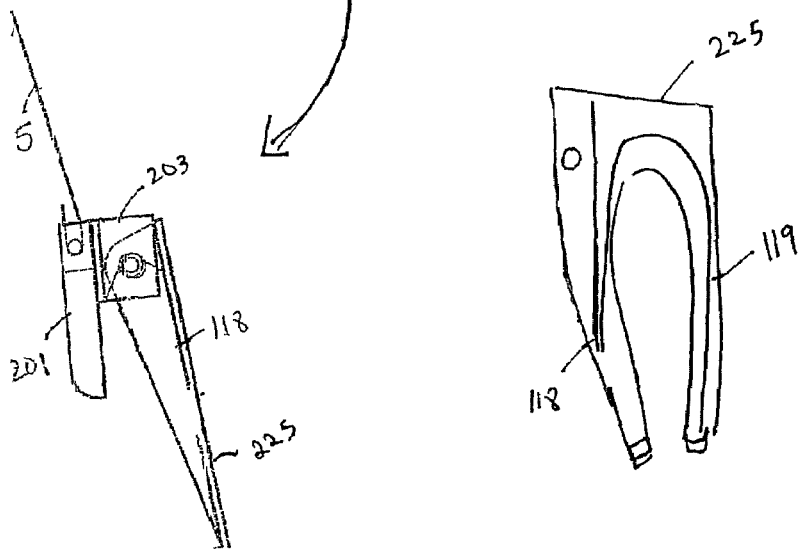
FIG. 21 is a view of a preferred embodiment of the invention, depicting the latch arms in the closed position.

Latch arms 218 and 219 further have an open position 224, as shown in FIG. 20 and a closed position 225, as shown in FIG. 21, and are configured to move between the two positions. In a preferred embodiment, latch arms 218 and 219 are configured to be biased against movement toward closed position 225. As shown in FIGS. 19 and 19A, this can be achieved by providing bolt 222 extending through openings 220 and 221 of latch arms 218 and 219 respectively, a biasing spring 223. In a preferred embodiment, latch arms 218 and 219, biasing spring 223, and control end 6 of cable 4 should be configured such that when control end 6 of cable 4 is pulled, latch arms 218 and 219 move to closed position 225 and spring 223 is compressed. When there is no longer a linear force being exerted on control end 6 of cable 4, biasing spring 223 relaxes to push arms 218 and 219 back to open position 224.

Figure 23:
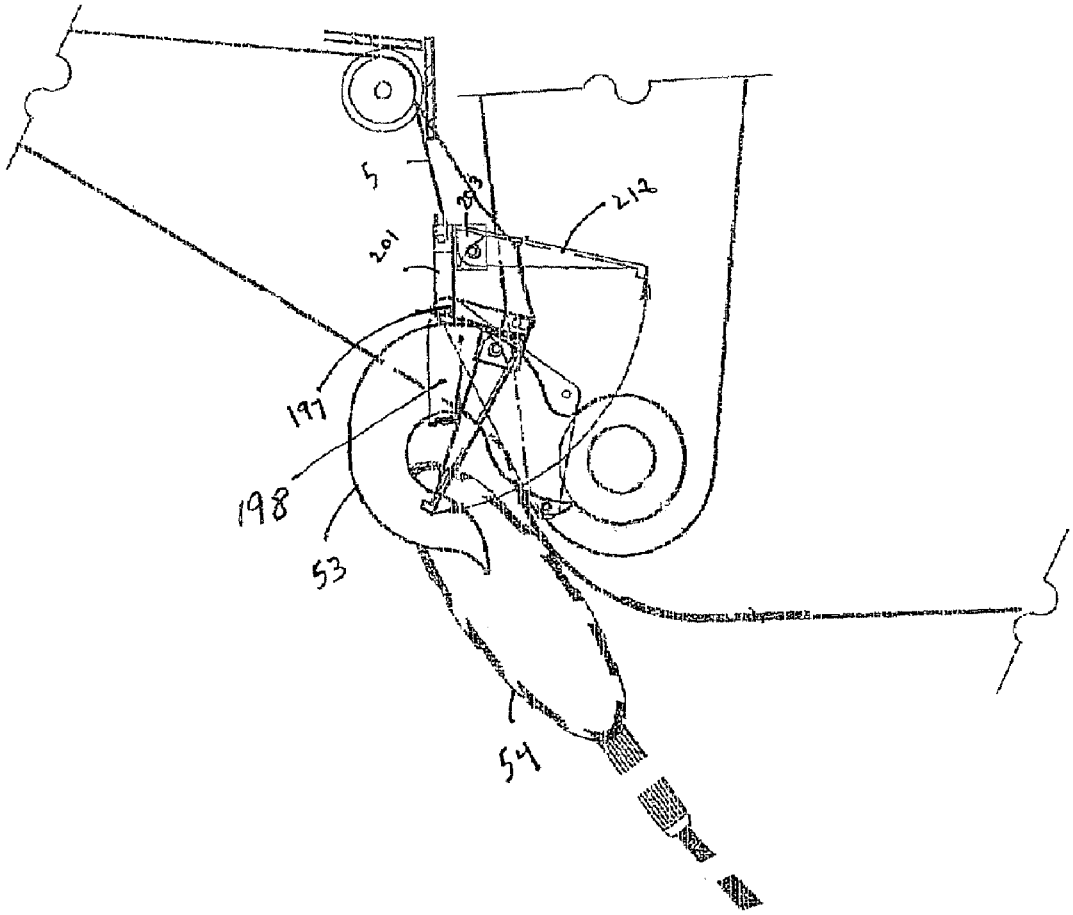
FIG. 23 is a view of a preferred embodiment of the invention, illustrating how the guard assembly functions to block the inadvertent release of the sling from the hook.
Figure 24:
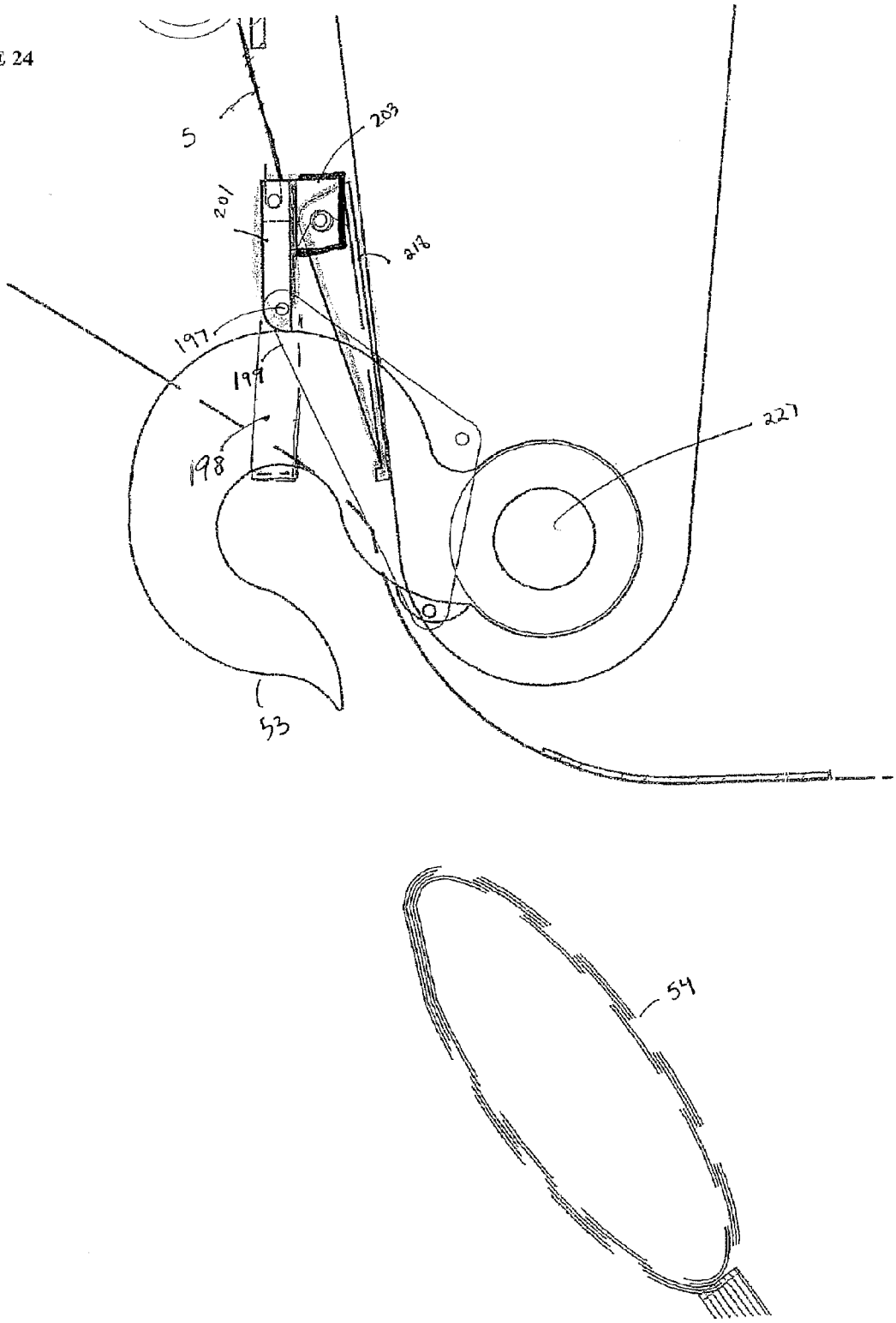
FIG. 24 is a view of a preferred embodiment of the invention, illustrating the positions of the various elements of the guard assembly when the load has been transported to the desired location and positioned at the final anchor location and released.

In operation, guard assembly 200 functions as follows. As depicted in FIG. 22, sling 54 is first applied to hook 53. Hook 53 is then put into safe position 9 i.e. tip end 48 of hook 53 is engaged to guard latch plate 47 situated within housing 2 of apparatus 1. At this point, latch arms 218 and 219 are in open position 224. When latch arms 218 and 219 are in open position 224, they can then be engaged to hook 53 on either side below its tip end 48. Assuming that sling 54 applied to hook 53 is of sufficient weight, this will then cause tip end 48 of hook 53 to be disengaged from guard latch plate 47. Furthermore, the weight of sling 54 may also be sufficient to push hook 53 toward a released position 52 prematurely. A shown in FIG. 23, in such a circumstance, as hook 53 is pushed toward released position 52, bar member 201 pivots at hinge point 197, to move latch arms 218 and 219, downwards. Thus, in this fashion, latch arms 218 and 219, in open position 224 and engaged to hook 53 on either side, move with hook 53, as hook 53 is moved toward released position 52, to block sling 54 from inadvertently slipping off of hook 53. After such a premature release of sling 54 has thereby been avoided, load 7 can then be applied to sling 54 and transported to a desired location and positioned for release. At this point, control end 6 of cable 4 may then be pulled. As shown in FIG. 24, when control end 6 is pulled, hook 53 pivots from loaded position 51 to released position 52. Furthermore, the application of a linear force to control end 6 of cable 4 causes latch arms 218 and 219 to move to closed position 225 and biasing spring 223 is compressed. When latch arms 218 and 219 move to closed position 225, they disengage hook 53 and no longer present a barrier for sling's 54 release from hook 53. Upon cessation of the linear force upon control end 6 of cable 4, biasing spring 223 relaxes to push latch arms 218 and 219 back to open position 224, whereby latch arms 218 and 219 can then be engaged to hook 53 for another load lift application.

In conclusion, the invention provides an improved apparatus 1 for the loading and unloading of materials that will make load-lift operations safer, more efficient, and less costly. In constructing apparatus 1, the inventor contemplates using steel. However, it is anticipated that various other materials could also be acceptable to construct apparatus 1. The suitability of a certain material would depend on various factors such as the weight of the load desired to be lifted, and the transporting distance.

While the invention has been described in terms of its preferred embodiment, other embodiments will be apparent to those of skill in the art from a review of the foregoing. Those embodiments as well as the preferred embodiments are intended to be encompassed by the scope and spirit of the following claims.

What is claimed is:

1. An apparatus, for the loading and unloading of materials comprising:

a.) a housing configured to operatively engage a lift line;

b.) a load-engaging member having a loaded position and a released position, the load-engaging member configured to move between the loaded position and the released position, the load-engaging member comprising a hook having an interior section and a mouth providing access to the interior section and configured to pivot between the loaded position and the released position; the hook being in the loaded position when the mouth of the hook is situated between the housing and the interior section of the hook and being in the released position when the mouth of the hook is at least level with the housing and the interior section of the hook;

c.) a cable having a load end operatively attached to the load-engaging member and a control end, wherein the cable further has a first position and a second position, wherein the cable is configured to move from the first position to the second position by the application of a linear force to the control end of the cable, wherein the cable is further configured to transmit linear force applied to the control end of the cable to the load-engaging member, whereby the load engaging member may be moved from the loaded position to the released position by the application of linear force to the control end of the cable, wherein the cable and load-engaging member are configured so that when the cable is moved from the first position to the second position, the load-engaging member is moved from the loaded position to the released position;

d.) a load-activated lock configured to secure the cable in the first position, and to thereby prevent the inadvertent movement of the load-engaging member from the loaded position to the released position, when a load is suspended from the load-engaging member, wherein the load-activated lock has a locked position and an unlocked position, wherein when in the locked position the load-activated lock is configured to engage the cable and secure the cable in the first position, wherein when in the unlocked position the load-activated lock is further configured to release the cable whereby the cable may be freely moved between the first position and the second position, wherein the load-activated lock is in mechanical communication with the hook, whereby the application of a load to the hook will move the load-activated lock from the unlocked position to the locked position.

2. An apparatus according to claim 1, wherein the load-activated lock is biased against movement from the unlocked position to the locked position, whereby the release of a load from the hook will allow the load-activated lock to return to its unlocked position.

3. A apparatus according to claim 2, wherein the load-activated lock is biased with a spring operatively attached to the load-activated lock, wherein the spring is positioned and configured to be compressed as the load-activated lock is moved from the unlocked position to the locked position, whereby the release of a load from the hook will allow the spring to relax and return the load-activated lock to the unlocked position.

4. An apparatus according to claim 3, wherein the cable further comprises a bar member situated between the load end of the cable and the control end of the cable, wherein the bar member is configured to slidably move within the housing with the cable from the first position to the second position, wherein the load-activated lock is configured to engage the bar when the cable is in the first position and when the load-activated lock is in the locked position, whereby the cable may be secured in the first position.

5. An apparatus according to claim 4, wherein the cable is biased against movement into the second position, such that when linear force exerted upon the control end ceases, the cable returns to the first position, allowing the hook to return to the loaded position.

6. An apparatus according to claim 5, wherein the cable is biased with a spring operatively attached to the bar member, wherein the spring is positioned and configured to be compressed as the cable is moved from the first position to the second position, whereby the cessation of linear force on the control end of the cable will allow the spring to relax and return the cable to the first position.

7. An apparatus for the loading and unloading of materials, comprising:

a.) a housing configured to operatively engage a lift line;

b.) a load-engaging member having a loaded position and a released position, the load-engaging member configured to move between the loaded position and the released position;

c.) a cable having a load end operatively attached to the load-engaging member and a control end, wherein the cable further has a first position and a second position, wherein the cable comprises a bar member having a locking cavity and situated between the load end of the cable and the control end of the cable and is configured to slidably move within the housing with the cable from the first position to the second position by the application of a linear force to the control end of the cable, wherein the cable is further configured to transmit linear force applied to the control end of the cable to the load-engaging member, whereby the load engaging member may be moved from the loaded position to the released position by the application of linear force to the control end of the cable, wherein the cable and load-engaging member are configured so that when the cable is moved from the first position to the second position, the load-engaging member is moved from the loaded position to the released position;

d.) a load-activated lock is configured having a locked position and an unlocked position to engage the cable in the locked position and secure the cable in the first position, and further configured to release the cable in the unlocked position, whereby the cable may be freely moved between the first position and the second position, the lock being in mechanical communication with the load-engaging member, whereby the application of a load to the load-engaging member moves the load-engaging member from the unlocked position to the locked position to thereby prevent the inadvertent movement of the load-engaging member from the loaded position to the released position, when the load is suspended from the load-engaging member, wherein the load-activated lock further comprises a locking plate positioned and configured to mate with the locking cavity of the bar member, when the cable is in the first position and when the load-activated lock is in the locked position, whereby the cable may be secured in the first position.

8. An apparatus according to claim 7, wherein the load-engaging member comprises a hook configured to pivot between the loaded position and the released position.

9. An apparatus according to claim 8, wherein the hook has an interior section and a mouth providing access to the interior section.

10. An apparatus according to claim 9, wherein the hook is in the loaded position when the mouth of the hook is situated between the housing and the interior section of the hook; wherein the hook is in the released position when the mouth of the hook is at least level with the housing and the interior section of the hook.

11. An apparatus according to claim 10, wherein the housing further comprises at least one pulley in operative engagement with the cable between the load end and the control end.

12. An apparatus according to claim 11, wherein the load-activated lock is biased against movement from the unlocked position to the locked position, whereby the release of a load from the hook will allow the load-activated lock to return to its unlocked position.

13. A apparatus according to claim 12, wherein the load-activated lock is biased with a spring operatively attached to the load-activated lock, wherein the spring is positioned and configured to be compressed as the load-activated lock is moved from the unlocked position to the locked position, whereby the release of a load from the hook will allow the spring to relax and return the load-activated lock to the unlocked position.

14. An apparatus according to claim 13, wherein the cable is biased against movement into the second position, such that when linear force exerted upon the control end ceases, the cable returns to the first position, allowing the hook to return to the loaded position.

15. An apparatus according to claim 14, wherein the cable is biased with a spring operatively attached to the bar member, wherein the spring is positioned and configured to be compressed as the cable is moved from the first position to the second position, whereby the cessation of linear force on the control end of the cable will allow the spring to relax and return the cable to the first position.

16. An apparatus according to claim 15, wherein the load-activated lock is configured to be adjustable to varying weights applied to the hook so that only the application of the desired load weight to the hook will trigger the load-activated lock to move from the unlocked position to the locked position.

17. An apparatus according to claim 16, further comprising a bracket member affixed to the hook, wherein the bracket member is positioned and configured to facilitate the pivoting of the hook from the loaded position to the released position.

18. An apparatus according to claim 17, wherein the hook further comprises a tip end.

19. An apparatus according to claim 18, further comprising a guard member positioned and configured to engage the tip end of the hook.

20. An apparatus according to claim 19, wherein the hook further has a safe position, wherein the hook is in the safe position when the tip end of the hook is engaged to the guard member, whereby the inadvertent release of a sling applied to the hook is prevented when the hook is in the safe position.

21. An apparatus according to claim 20, further comprising a second load-engaging member.

22. An apparatus according to claim 21, wherein the second load-engaging member comprises a hook.

23. An apparatus according to claim 22, further comprising a latch arm having an open position and a closed position, the latch arm configured to move between the open position and the closed position.

24. An apparatus according to claim 23, wherein the latch arm, in the open position, is configured and positioned to be engaged to the hook, and to move with the hook, when the hook is pushed prematurely to the released position, via a force other than linear force applied to the control end of the cable, whereby the movement of the latch arm with the hook blocks the inadvertent release of a sling applied to the hook.

25. An apparatus according to claim 24, wherein the latch arm, in the closed position, is configured and positioned to disengage from the hook.

26. An apparatus according to claim 25, wherein the latch arm is configured to be biased against movement toward the closed position.

27. An apparatus according to claim 26, wherein the latch arm is biased with a spring operatively attached to the latch arm.

28. An apparatus according to claim 27, wherein the spring, the latch arm, and the control end of the cable are positioned and configured such that when linear force is applied to the control end of the cable, the latch arm moves to the closed position and disengages from the hook, and the spring is compressed, whereby the cessation of linear force on the control end will allow the spring to relax and return the latch arm to the open position.

29. An apparatus, for the loading and unloading of materials, comprising:

a.) a housing configured to operatively engage a lift line;

b.) a load-engaging member having a loaded position and a released position, the load-engaging member configured to move between the loaded position and the released position;

c.) a cable having a load end operatively attached to the load-engaging member and a control end, wherein the cable further has a first position and a second position, wherein the cable is configured to move from the first position to the second position by the application of a linear force to the control end of the cable, wherein the cable is further configured to transmit linear force applied to the control end of the cable to the load-engaging member, whereby the load engaging member may be moved from the loaded position to the released position by the application of linear force to the control end of the cable, wherein the cable and load-engaging member are configured so that when the cable is moved from the first position to the second position, the load-engaging member is moved from the loaded position to the released position;

d.) a means to secure the cable in the first position, and to thereby prevent the inadvertent movement of the load-engaging member from the loaded position to the released position, when a load is suspended from the load-engaging member.

* * * * *